US010315303B2

(12) United States Patent
Kidd

(10) Patent No.: US 10,315,303 B2
(45) **Date of Patent: *Jun. 11, 2019**

(54) MODULAR FABRICATION TABLE

(71) Applicant: John Kidd, Brighton, CO (US)

(72) Inventor: John Kidd, Brighton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/423,286

(22) Filed: Feb. 2, 2017

(65) Prior Publication Data

US 2018/0326571 A1 Nov. 15, 2018

Related U.S. Application Data

(63) Continuation-in-part of application No. 29/555,311, filed on Feb. 19, 2016, now Pat. No. Des. 784,739.

(51) Int. Cl.

| | |
|---|---|
| ***B25H 1/04*** | (2006.01) |
| ***A47B 13/00*** | (2006.01) |
| ***B25H 1/16*** | (2006.01) |
| ***B25H 1/02*** | (2006.01) |
| ***B25H 1/14*** | (2006.01) |
| ***A47B 96/18*** | (2006.01) |
| *A47B 37/00* | (2006.01) |
| *B25H 1/18* | (2006.01) |
| *A47B 13/08* | (2006.01) |
| *A47B 87/00* | (2006.01) |
| *A47B 1/00* | (2006.01) |

(52) U.S. Cl.

CPC ..... *B25H 1/04* (2013.01); *A47B 96/18* (2013.01); *B25H 1/02* (2013.01); *B25H 1/14* (2013.01); *B25H 1/16* (2013.01); *A47B 1/00* (2013.01); *A47B 13/003* (2013.01); *A47B 13/088* (2013.01); *A47B 87/002* (2013.01); *A47B 2037/005* (2013.01); *A47B 2200/001* (2013.01); *B25H 1/18* (2013.01)

(58) Field of Classification Search

CPC ..... A47B 7/00; A47B 13/00; A47B 13/003; A47B 2200/0016; B25H 1/00; B25H 1/02; B25H 1/04; B25H 1/06

USPC ..... 33/568; 108/11, 12, 54.1; 248/188.9

See application file for complete search history.

(56) References Cited

U.S. PATENT DOCUMENTS 2,917,261 A * 12/1959 Stough ..... A47B 57/04 108/54.1
2,981,577 A * 4/1961 Trautmann ..... A47B 37/00 108/185
3,207,095 A * 9/1965 Hiatt, Jr. ..... A47B 87/0223 108/53.5
3,329,103 A * 7/1967 Cohen ..... B65D 19/0095 108/54.1
3,355,167 A * 11/1967 Rceves ..... B65H 1/04 108/54.1

(Continued)

*Primary Examiner* — Christopher W Fulton

(74) *Attorney, Agent, or Firm* — Regan L. Trumper; William W. Cochran; Cochran Freund & Young, LLC

(57) ABSTRACT

Existing fabrication tables are often expensive, immobile, unsafe, and difficult to work with. This invention comprises a modular fabrication table, which is rapidly adaptable to expand over a large surface area, add perpendicular work surfaces, and integrate existing peripheral components that can be purchased at a store. This allows fabrication prototypers to have relatively inexpensive, mobile, sturdy, square, and level tables within which to configure structures for the production of fabrication work pieces.

5 Claims, 33 Drawing Sheets

(56) References Cited

U.S. PATENT DOCUMENTS 3,863,784 A * 2/1975 Webb ..... B65D 19/0002 108/51.3
4,062,301 A * 12/1977 Pitchford ..... B23P 19/041 108/54.1
4,186,667 A * 2/1980 Seabrook ..... B65D 19/08 108/53.5
4,190,001 A * 2/1980 Cecala ..... A47B 13/04 108/161
4,699,280 A * 10/1987 Hoss ..... B65D 19/08 108/54.1
4,703,911 A * 11/1987 Rammell ..... F16M 7/00 248/188.9
5,388,532 A * 2/1995 Wakano ..... B65D 19/12 108/54.1
7,293,509 B2 * 11/2007 Hassell ..... B65D 19/004 108/51.11
8,267,018 B2 * 9/2012 Gunn ..... B65D 19/0024 108/51.11
9,789,601 B1 * 10/2017 Judge ..... B25H 1/06
9,862,088 B2 * 1/2018 Luis y Prado ..... B25H 1/04
2005/0039644 A1 * 2/2005 Sheahan ..... A47B 57/50 108/152
2007/0017420 A1 * 1/2007 Hadar ..... B65D 19/0048 108/54.1
2008/0282942 A1 * 11/2008 Hawkins ..... A47B 37/04 108/157.1
2010/0282133 A1 * 11/2010 Wong ..... B23K 37/0461 108/50.11
2013/0074744 A1 * 3/2013 Wright ..... A47B 3/06 108/156
2013/0319296 A1 * 12/2013 Lio ..... F16B 12/44 108/157.1
2015/0204061 A1 * 7/2015 Saich ..... F24F 13/32 248/188.9

* cited by examiner

MODULAR FABRICATION TABLE

CROSS REFERENCE TO RELATED APPLICATIONS

Not applicable

REFERENCE TO GOVERNMENT FUNDING SOURCES

Not applicable.

REFERENCE TO SEQUENCE LISTING

Not applicable.

BACKGROUND

Fields of the Invention

The disclosure as detailed herein is in the technical field of prototyping. More specifically, the present disclosure relates to the technical field of manufacturing. Even more specifically, the present disclosure relates to the technical field of modular fabrication tables.

Description of Related Art

Tables are commonly found in laboratories. They have to be sturdy and multiuse and, therefore, are usually fixed as part of a structure and immobile. Further, laboratory tables often have very heavy-duty countertops using such materials as soapstone. This causes laboratory tables to be difficult to setup in the manner that are needed for specific experiments, as they are fixed into place and are immobile. Further, due to their heavy weight, it is not easy to move laboratory tables into new configurations.

Fabricators are people who need to have a wide variety of arrangements and configurations to hold pieces they are assembling. Therefore, tables need to be both mobile but firm and need to accommodate specific spaces in a work area. These tables need to be flat, level, and square and able to hold components of a work piece in particular configurations. Existing tables in fabrication shops are often not adaptable and clamp locations are usually limited to the periphery. Fabricators often need to design configurations around the existing tables that they have, which usually takes a lot of time. Further, different work pieces often require different anchoring strengths for accurate positioning. In addition, safety is a big concern with setting up or working on one or more work pieces. A further consideration for a fabrication table is they often need to have surfaces of different materials that are compatible with the work pieces that are being worked on.

They may also need to have means for bolting in both an upwards and downwards perpendicular plane for configuration of work pieces. Further, it may also be desirable to have a means to configure a production or prototype the area to particular needs for particular products. Existing modular fabrication tables are often prohibitively expensive and require specific compatible clamps that must be purchased. In summary, fabrication prototypers often have work spaces that have limited surface area and use tables that are not for the purposes of fabrication. Tables that are used can be immobile or too mobile and, thus, give out under stress. Further, fabrication tables can be out of level, out of square, and have irregular surface structure. The non-adaptability of tables in a fabrication shop often cost money, because setting up configurations is time consuming and requires a great deal of creativity.

GENERAL SUMMARY OF THE INVENTION

Existing fabrication tables are often immobile, unsafe, and difficult to work with. This invention comprises a modular fabrication table, which is rapidly adaptable to expand over a large surface area, add perpendicular work surfaces, and integrate existing peripheral components that can be purchased at a store. This allows fabrication prototypers to have mobile, sturdy, square, and level tables within which to configure structures for the production of fabrication work pieces.

An embodiment of the instant invention allows one to have an N number of units that can interconnect in order to grow the work surface area. Yet another embodiment of the invention allows one to very easily set up an experiment for lab personnel. Yet another embodiment of the invention allows one to move the fabrication table to multiple spots in a lab as needed. Yet another embodiment of the invention allows one to have a variable means for mobility and anchoring for lab experiments. Yet another embodiment of the invention allows one to have a variable size of surface area and volume for assembly and fixturing for fabricators. Yet another embodiment of the invention allows one to have a variable mobility mechanism to be able to adapt to the needs for fixturing of the work pieces.

Yet another embodiment of the invention allows one to not have to make adjustments for tables that are not flat. Yet another embodiment of the invention allows one to not to worry about the flatness of the surface for present and future work pieces. Yet another embodiment of the invention allows one to to adjust the level of the table to suit the needs of the fixturing or work pieces.

Yet another embodiment of the invention allows one to not worry about the squareness of the table for work to be performed. Yet another embodiment of the invention allows one to allows one to to be able to hold component pieces of a work piece in particular configurations. Yet another embodiment of the invention allows one to have a low cost adaptable fabrication table.

Yet another embodiment of the invention allows fixturing and clamp locations to be configured as needed in the center or interior portions of a table as well as throughout the entire work area. Yet another embodiment of the invention allows one to have only one table that can be used for working on a particular project or projects.

Yet another embodiment of the invention allows one to have a strong anchoring substrate based on the design of the modular surface tube. Yet another embodiment of the invention allows one to have a safer working environment. Yet another embodiment of the invention allows one to have a fence or upwards perpendicular plane to attach to the fabrication table and support fixturing.

Yet another embodiment of the invention allows one to have an apron to attach to the fabrication table and support fixturing below the surface of the table. Yet another embodiment of the invention allows one to have adaptable materials for a sanitary workspace. Yet another embodiment of the invention allows one to have a means to configure a production or prototyping area to particular needs for assembly or line production. An additional embodiment allows one to use clamps and fixturing devices that are specific to the modular table itself AND accommodate non-specific clamps and devices of various types and brands.

DETAILED DESCRIPTION OF THE INVENTION

Figure 1:
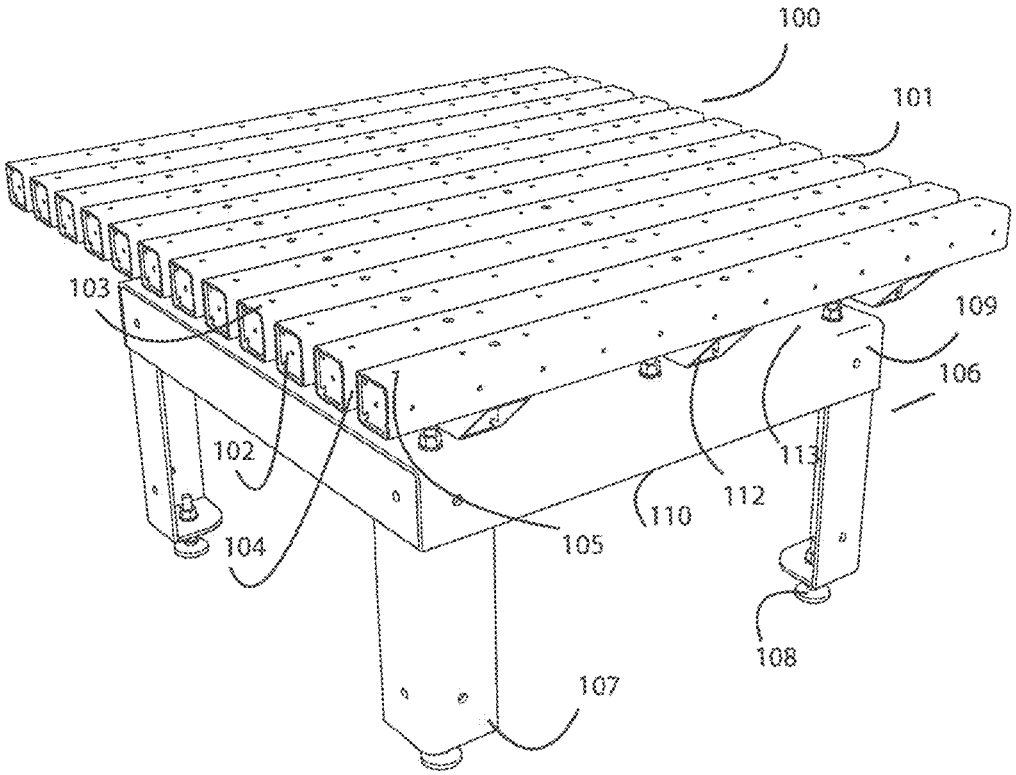
FIG. 1 is a perspective view which shows the base and working surface and related components.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Referring now to FIG. 1, which shows the base and working surface and related components. Working surface 100 (as in FIG. 1) comprises the flat surface that a user interacts with made up of one or more MSU 101. Working surface 100 preferably comprises one or more MSU 101, one or more inter-MSU space 104, and finally fixture aperture grid 105. MSU 101 (as in FIG. 1) comprises a modular unit of a specific material that becomes one or more surfaces of the fabrication table. The (MSU 101) is an acronym which stands for 'modular surface unit'. MSU 101 is mainly thought to be composed of steel, however other embodiments may be composed of any of the following: stainless steel, aluminum, wood, plastic, polymers, rubber polymers, composites with different coatings, or any suitable metal. MSU 101 is preferably shaped like a capped tube, however, it is thought that in alternative embodiments that it may also be shaped like a solid block, an open tube, or a hollow and capped block. In some embodiments, MSU 101 has a preferred width of 3.5 inches but in other embodiments, may range from a minimum of 2 inches to a maximum width of 12 inches. In general, the maximum value of the width can be calculated by the overall needs of the structure of project.

In some embodiments, MSU 101 has a preferred height of 3.5 inches but in other embodiments, may range from a minimum of 2 inches to a maximum height of 12 inches. In general, the maximum height value can be calculated by the overall needs of the structure of project. In some embodiments, MSU 101 has a preferred length of 60 inches but in other embodiments, may range from a minimum of 15 inches to a maximum length of 240 inches. In general, the preferred length value can be calculated by the overall needs of the structure of project. In some embodiments, MSU 101 has a preferred weight of 40 lbs but in other embodiments, may range from a minimum of 1 lbs to a maximum weight of 150 lbs. The purpose of the preferred weight value is to have a weight that is manageable by one person. In general, the preferred weight value can be calculated by the overall needs of the structure of project.

In some embodiments, MSU 101 has a preferred wall thickness of 3/16 inches but in other embodiments, may range from a minimum of 1/8 inches to a maximum wall thickness of 1 inches. MSU 101 preferably comprises at least an MSU end 102, MSU top surface 103, MSU side surface 1103, MSU bottom surface 1800, MSU interior aperture, fixturing aperture 1104, one or more fixturing aperture distance 1105, and finally one or more corner radial curve 1106. MSU 101 has a couple alternative embodiments herein termed the "four side' embodiment' embodiment and the 'solid' embodiment. The "four side' embodiment' embodiment comprises an MSU where there are no specific oriented sides and attachment to peripherals and MFU can still occur. The 'solid' embodiment comprises an MSU where there is no interior aperture.

Inter-MSU space 104 (as in FIG. 1) comprises the space between two parallel adjacent MSU 101, which is taken into account when used to calculate the dimensions of the squares of fixture aperture grid 105 along with fixturing aperture distance 1105. In some embodiments, inter-MSU space 104 has a preferred width of 1.5 inches but in other embodiments, may range from a minimum of 0.5 inches to a maximum width of 12 inches. In general, the preferred width value can be calculated by the value that is large enough to accept clamps and attachments through working surface 100. It can further be calculated by the value that allows one to create a grid of fixture apertures from two or more adjacent MSU when attached to the base.

Fixture aperture grid 105 (as in FIG. 1) comprises the grid that is created as a function of MSU width and inter-MSU space 104 that creates a grid of fixturing apertures 1104 so that components or fixturing peripheral 2700 can be reused in different places. MSU end 102 (as in FIG. 1) comprises an apical region on the end of MSU 101. One goal of MSU end 102 is to allow the fixturing of vertical MSU 101 and potentially other components, such as peripherals. MSU end 102 preferably comprises one or more MSU end cap 1100 and one or more MSU end angle 1101. MSU top surface 103 (as in FIG. 1) comprises the flat top surface of MSU 101 that when combined with other MSU 101 makes the flat work surface. MSU top surface 103 preferably comprises recessed anchoring aperture 1102.

Figure 4:
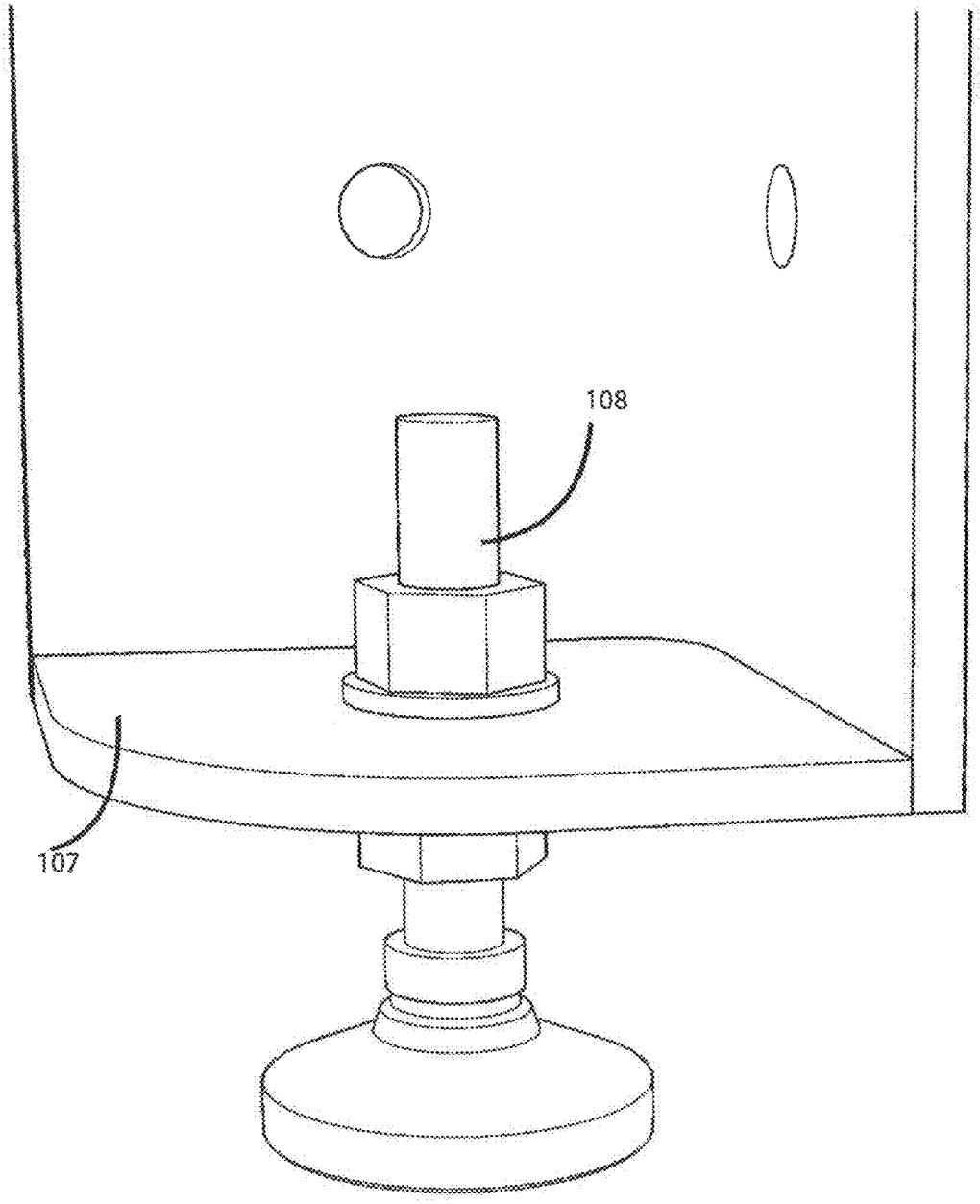
FIG. 4 is a perspective view which shows the leveling mechanism of the legs.
Figure 5:
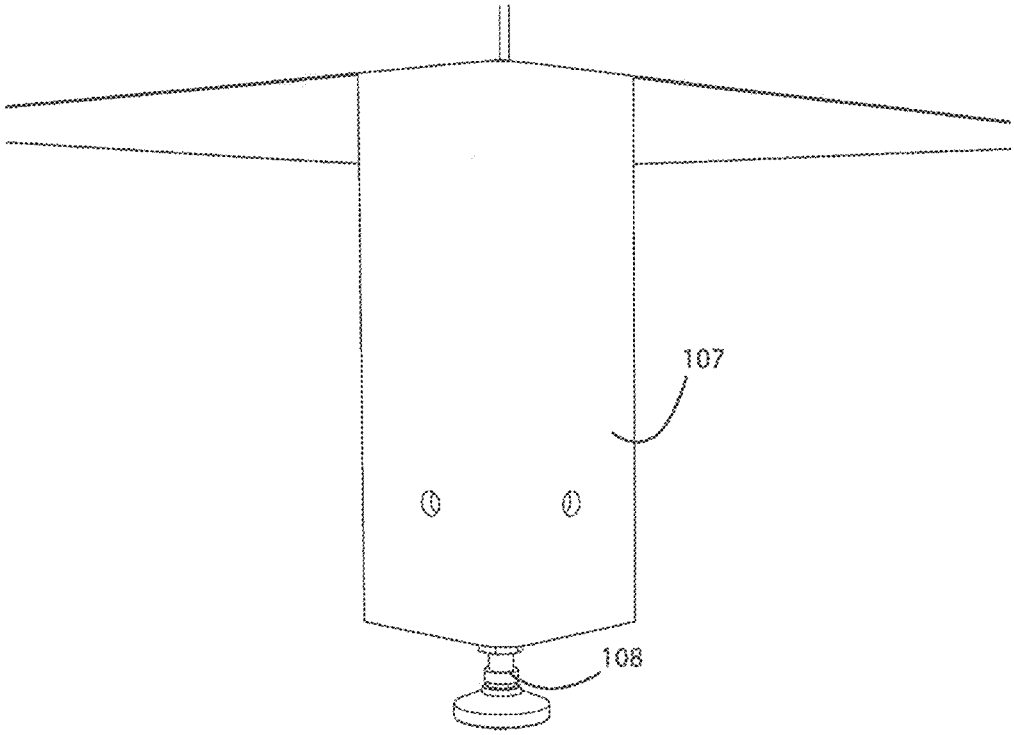
FIG. 5 is a perspective view which shows the leveling mechanism of the legs.

Legs 107 (as in FIGS. 1 and 4 and 5) comprises the physical support for anchoring frame 109, preferably perpendicular. Legs 107 preferably comprise one or more leveling mechanism 108. Anchoring frame 109 (as in FIG. 1) comprises a structure that sets the foundation for the squareness of working surface 100. Anchoring frame 109 preferably comprises frame aperture 200 and one or more frame edge unit 110. Leveling mechanism 108 (as in FIGS. 1 and 4 and 5) comprises an adjustable mechanism that operably connects to one or more legs 107 that allows a user to adjust the level of one or more working surface 100.

Frame edge unit 110 (as in FIG. 1) comprises a support for an anchoring frame, that in a preferred embodiment, has a count of four and establishes the square of the anchoring frame. Frame edge unit 110 preferably comprises side mounting surface 201, top mounting surface 202, and finally interior mounting surface 203. Frame edge unit 110 has an alternative embodiment herein termed the 'electrical box' embodiment. The 'electrical box' embodiment comprises an embodiment where one or more electrical boxes or power sources are otherwise affixed to the interior mounting surface 203 of a frame edge unit 110. Frame edge unit 110 has an additional alternative embodiment herein termed the 'tool holder' embodiment. The 'tool holder' embodiment comprises an embodiment where one or more apparatuses are configured to attach to the frame edge unit that holds or wields tools.

MFU 112 (as in FIG. 1) comprises a modular unit that establishes the foundation for the work surface 100. The (MFU 112) is an acronym which stands for 'modular framing unit'. MFU 112 is mainly thought to be composed of steel, however other embodiments may be composed of any of the following: stainless steel, aluminum, plastic, wood, polymers, rubber polymers, composites with different coatings, or any suitable metal. MFU 112 is preferably shaped like a capped tube, however, it is thought that in alternative embodiments that it may also be shaped like a solid block, an open tube, or a hollow and capped block. In some embodiments, MFU 112 has a preferred width of 3.5 inches but in other embodiments, may range from a minimum of 2 inches to a maximum width of 12 inches. In general, the maximum width value can be calculated by the overall needs of the structure of project.

In some embodiments, MFU 112 has a preferred height of 3.5 inches but in other embodiments, may range from a minimum of 2 inches to a maximum height of 12 inches. In general, the maximum height value can be calculated by the overall needs of the structure of project. In some embodiments, MFU 112 has a preferred length of 60 inches but in other embodiments, may range from a minimum of 15 inches to a maximum length of 240 inches. In general, the preferred length value can be calculated by the overall needs of the structure of project.

In some embodiments, MFU 112 has a preferred weight of 40 lbs but in other embodiments, may range from a minimum of 1 lbs to a maximum weight of 150 lbs. The purpose of the preferred weight value is to have a weight that is manageable by one person. In general, the preferred value can be calculated by the overall needs of the structure of project. In general, the maximum weight value can be calculated by the overall needs of the structure of project. In general, the minimum value can be calculated by the overall needs of the structure of project.

In some embodiments, MFU 112 has a preferred wall thickness of 3/16 inches but in other embodiments, may range from a minimum of 1/8 inches to a maximum wall thickness of 1 inches. MFU 112 preferably comprises at least an MFU end 204, MFU top surface 205, at least one MFU side surface 206, MFU bottom surface 701, one or more MSU attachment aperture 900, and preferably MFU interior aperture (the central interior aperture of the hollow MFU 112 (in a preferred embodiment)). MFU 112 has an alternative embodiment herein termed the 'fixture aperture containing' embodiment. The 'fixture aperture containing' embodiment comprises an embodiment, where the MFU may contain one or more fixturing aperture for one or more fixturing peripheral.

Inter-MFU space 113 allows for the consideration of: the less space (or the more MFU) allows more unit increments of distance for MSUs to be arranged for particular patterns and/or interaction with other fabrication tables. The inter-MFU space 113 allows the expansion of working surface 100 beyond the original dimensions, for one or more fabrication tables to interact with one another. In a preferred embodiment, inter-MFU space 113 has a preferred width of 20 inches but in other embodiments, any quantity of unit increments of distance for MSUs to be arranged for particular patterns and/or interaction with other fabrication tables may suffice.

Anchoring surface 111 (as in FIG. 1) comprises the combination of one or more MFU 112 that establishes a foundation for the work surface 100. Anchoring surface 111 preferably comprises one or more MFU 112 and one or more inter-MFU space 113. Base 106 (as in FIG. 1) comprises the support for the work surface 100 that may be configured for modularity and establish a level planes for a user. Base 106 preferably comprises one or ore legs 107, anchoring frame 109, one or more adaptable attachment components 300, and finally anchoring surface 111. Base 106 has an alternative embodiment herein termed the 'scissors style' embodiment. The 'scissors style' embodiment comprises an embodiment that has one or mechanisms for adjusting the work surface height via a scissors mechanism.

Figure 2:
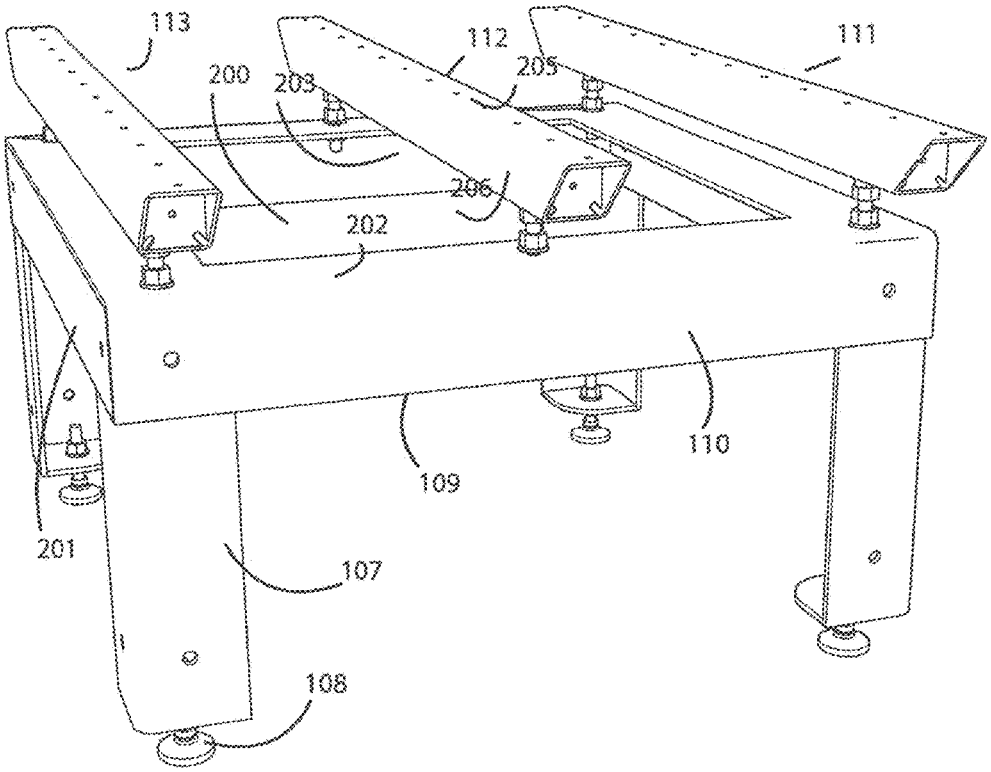
FIG. 2 is a perspective view which shows the base and related components.

Referring now to FIG. 2, which shows the base and related components. Frame aperture 200 (as in FIG. 2) comprises an aperture of anchoring frame 109 that allows the anchoring frame to have structural integrity but be light weight. In some embodiments, it is thought that if frame aperture 200 is absent then a solid sheet may suffice. Side mounting surface 201 (as in FIG. 2) comprises the side of frame edge unit 110 that in some embodiments allows connection to other side mounting surface 201 or adaptable attachment components 300. Top mounting surface 202 (as in FIG. 2) comprises the top of frame edge unit 110 that preferably interacts with adaptable attachment components 300. Interior mounting surface 203 (as in FIG. 2) comprises the underside or interior of frame edge unit 110 that preferably interacts and affixes one or more adaptable attachment components 300. MFU end 204 (as in FIG. 2) comprises an apical region on the end of MFU 112. MFU end 204 preferably comprises the one or more MFU angled edge and one or more MFU end cap 700. MSU top surface 207 comprises the flat top surface of the MSU that when combined with other MSU makes the flat work surface. The MSU top surface 207 preferably comprises the recessed anchoring aperture 1102. MFU side surface 206 (as in FIG. 2) comprises the perpindicular surface to MFU top surface 205.

Figure 3:
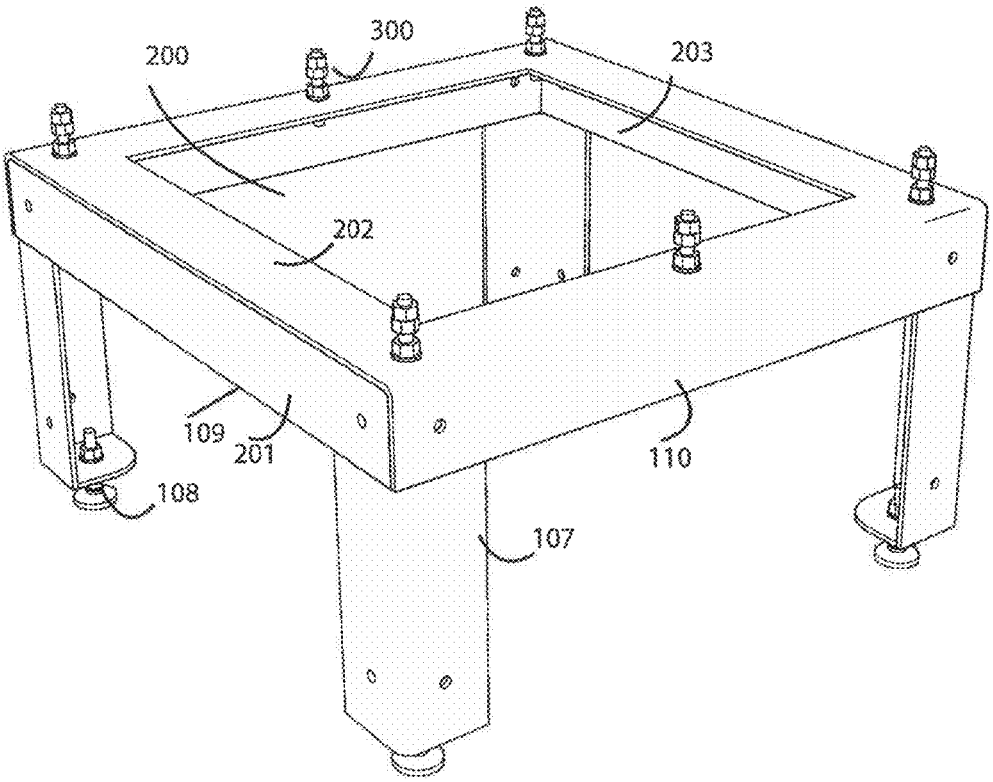
FIG. 3 is a perspective view which shows the anchoring frame and related components.

Referring now to FIG. 3, which shows the anchoring frame and related components. Adaptable attachment components 300 (as in FIG. 3) comprises a mechanism to attach the anchor frame to one or more MFU 112 or another portion of another base 106. Adaptable attachment components 300 preferably comprises separator rod 600 and micro adjustment leveling mechanism 601.

Figure 6:
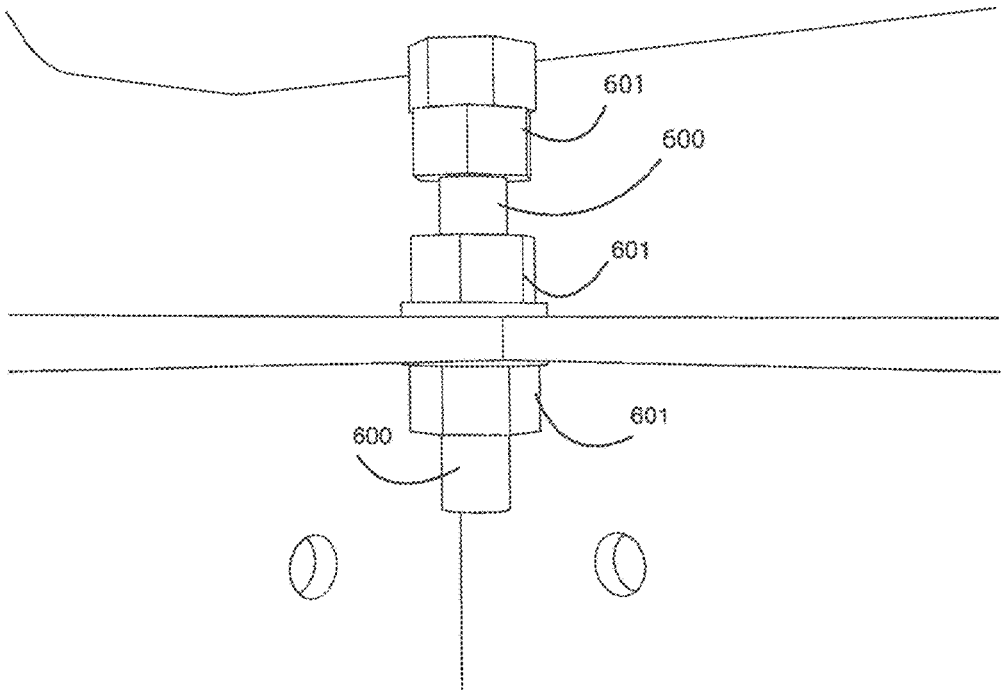
FIG. 6 is a perspective view which shows an adaptable attachable component attached to an MFU and frame edge unit.

Referring now to FIG. 6, which shows an adaptable attachable component attached to an MFU and frame edge unit. Seperator rod 600 (as in FIG. 6) comprises a mechanism for attaching one surface to another that interacts with one or more micro adjustment leveling mechanism 601 that is strong enough support one or more work pieces plus work surfaces. Micro adjustment leveling mechanism 601 (as in FIG. 6) comprises a means for attaching frame edge unit 110 to another component while providing a means for changing distances between them via interaction with seperator rod 600. In some embodiments, it is thought that an example of micro adjustment leveling mechanism 601 could be nuts and bolts or perhaps adjustable clamps and the like.

Figure 7:
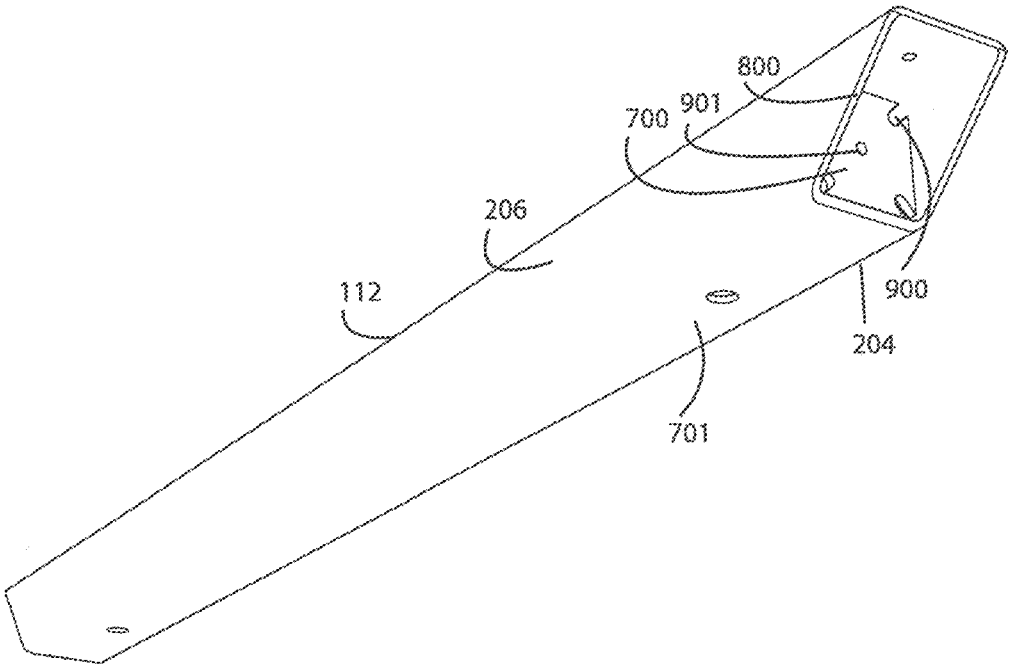
FIG. 7 is a bottom perspective view which shows an MFU.

Referring now to FIG. 7, which shows an MFU. MFU end cap 700 functions to both 1) support the MFU during stress and to 2) allow attachment for fixtures. MFU end cap 700 preferably comprises one or more MFU monitoring holes and one or more MFU center fixturing hole. MFU bottom surface 701 (as in FIG. 7) comprises the MFU surface that faces towards anchoring frame 109.

Figure 8:
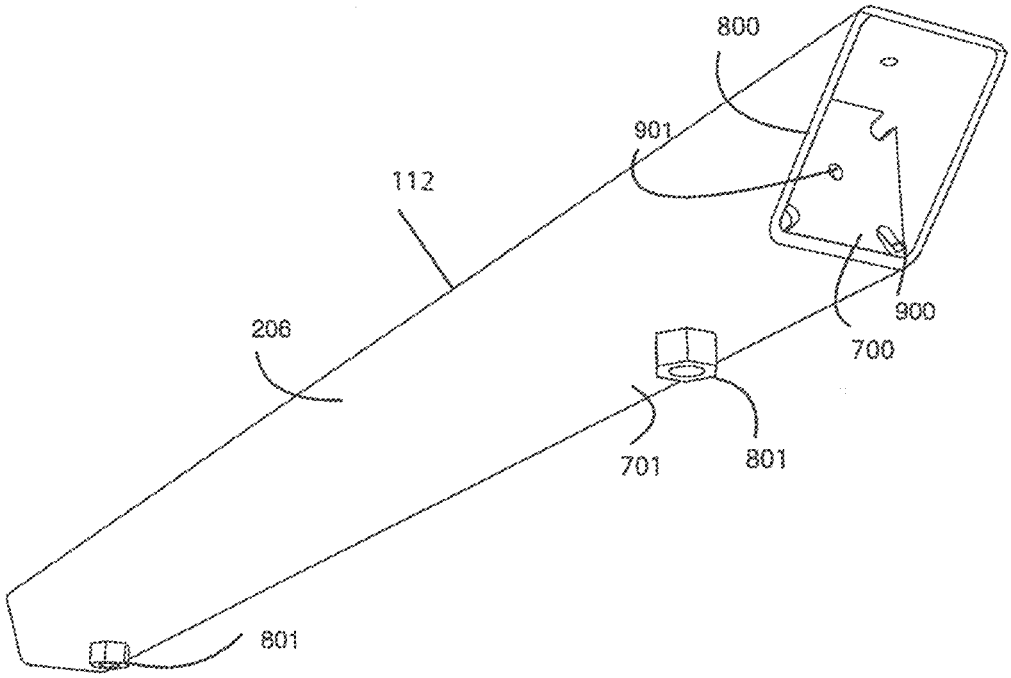
FIG. 8 is a bottom perspective view which shows an MFU with an attachment mechanisms to one or more adaptable attachable components.

Referring now to FIG. 8, which shows an MFU with an attachment mechanisms to one or more adaptable attachable components. In some embodiments, MFU angled edge 800 has a preferred angle of 45 degrees but in other embodiments, may range from a minimum of 15 degrees to a maximum angle of 90 degrees. MFU angled edge 800 functions to both 1) prevent a user of the table from catching their clothes or body while working and to 2) provide additional clearance for work being done in the area. In some embodiments, it is thought that if MFU angled edge 800 is absent then can be done without the angled edge, though in some embodiments, is less preferable. In some embodiments, MFU bottom attachment mechanism 801 may be used to attach one or more MFU to one or more adaptable attachable components.

Figure 9:
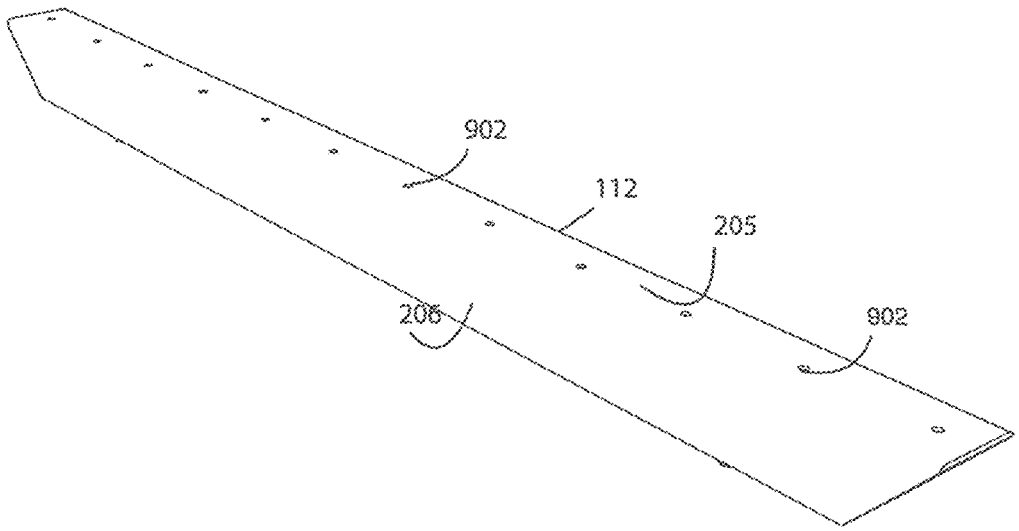
FIG. 9 is a top perspective view which shows an MFU.
Figure 10:
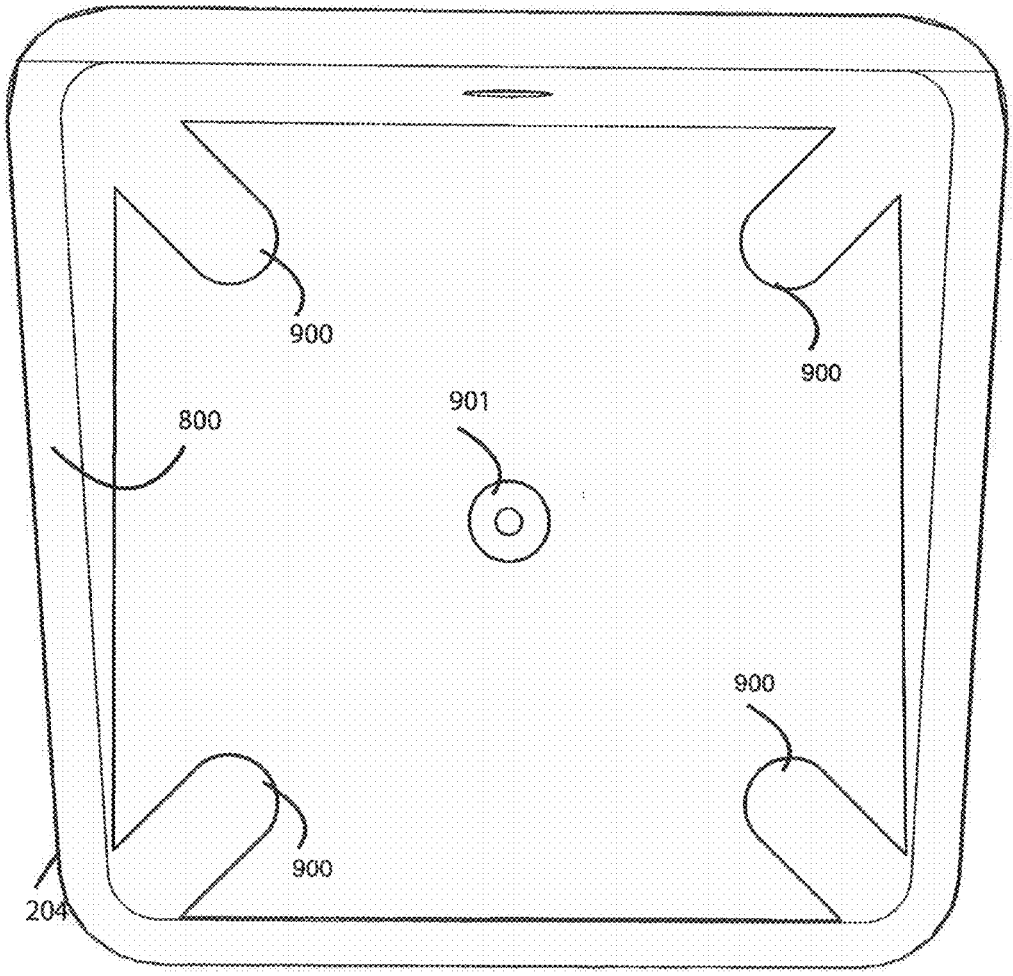
FIG. 10 is a end facing perspective view which shows an MFU end.
Figure 11:
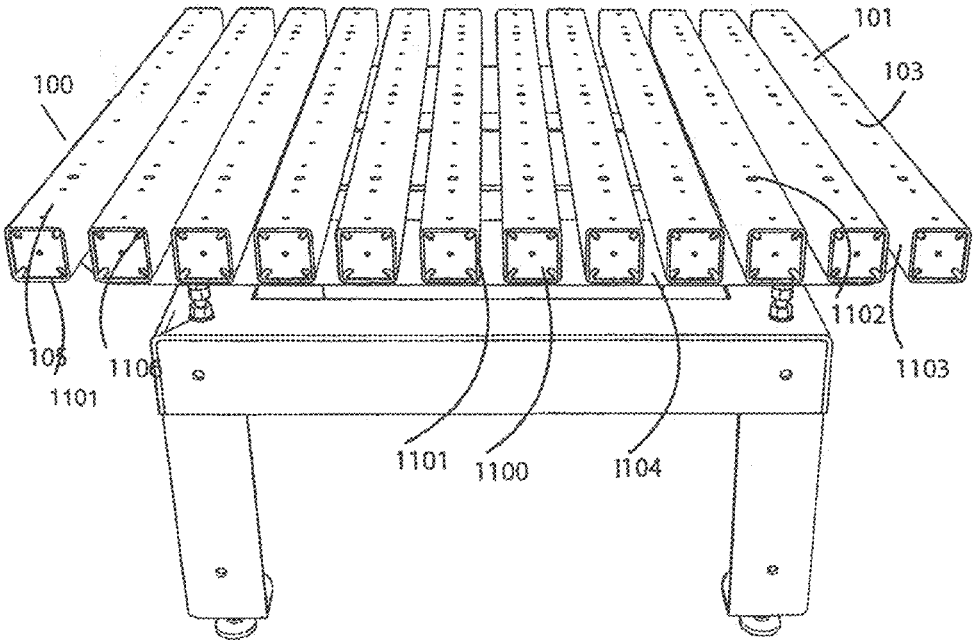
FIG. 11 is a top perspective view which shows a working surface of MSUs on top of a base.
Figure 12:
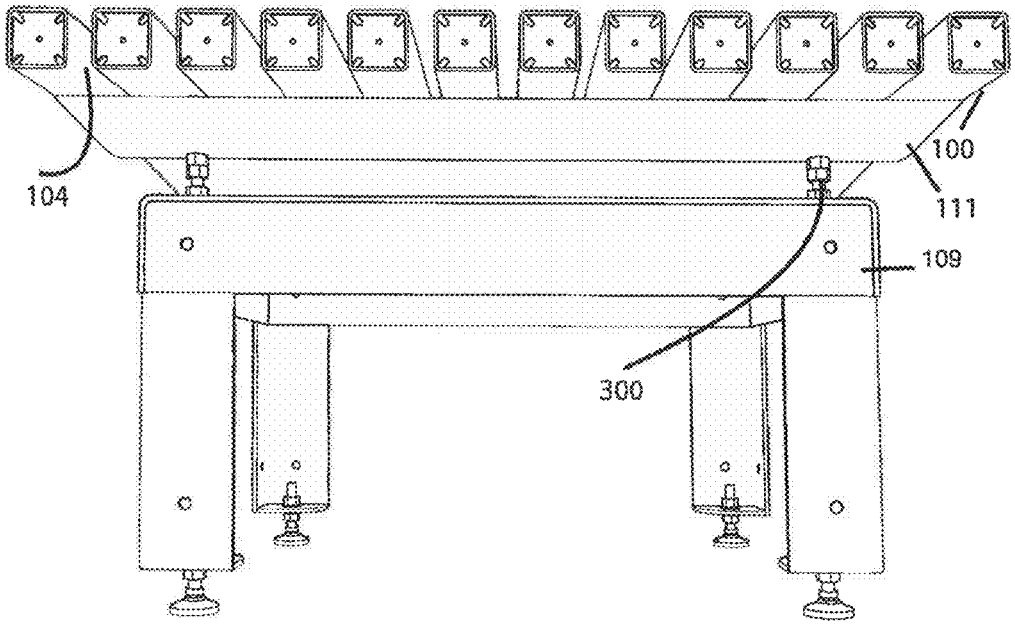
FIG. 12 is a bottom perspective view which shows a working surface of MSUs on top of a base.
Figure 13:
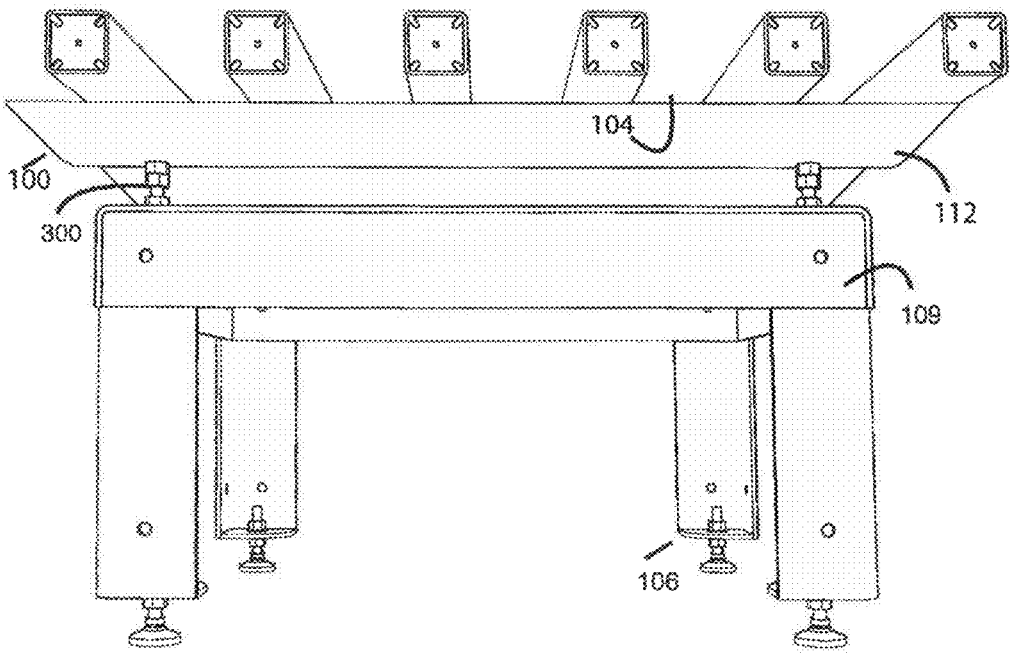
FIG. 13 is a bottom perspective view which shows a working surface of MSUs on top of a base, where inter MSU space is considerable.
Figure 14:
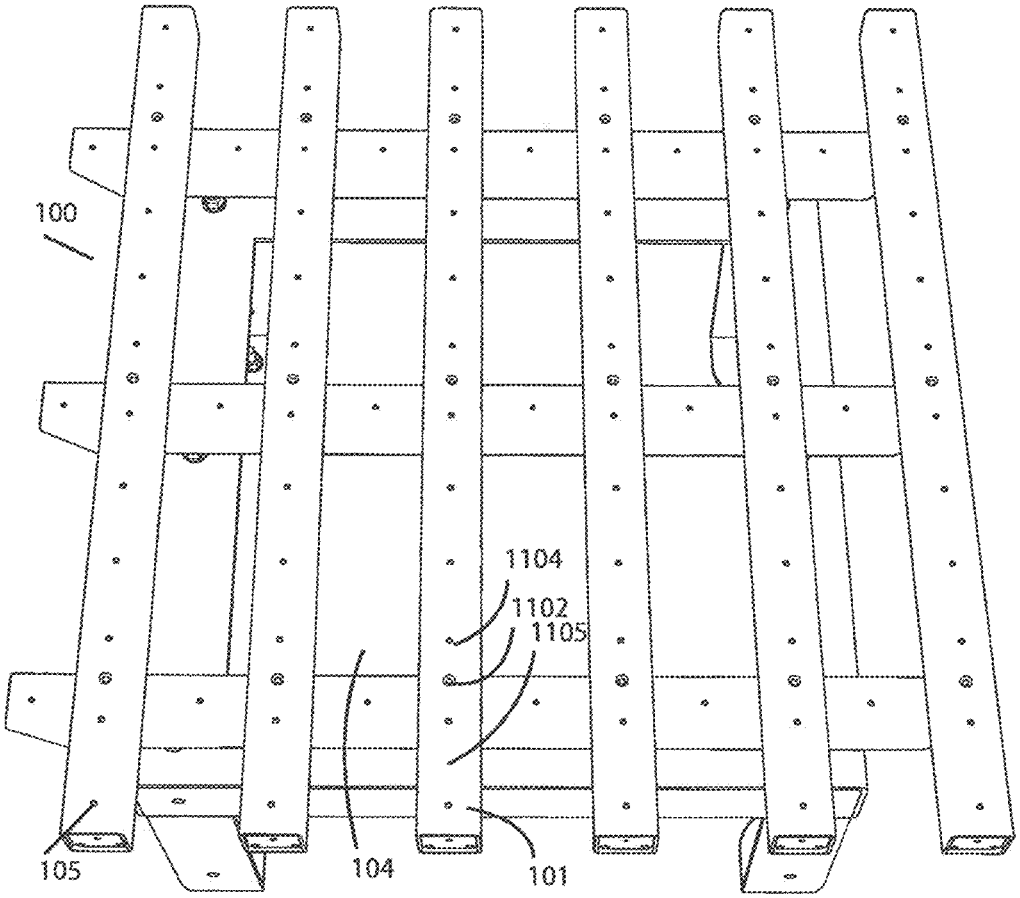
FIG. 14 is a top perspective view which shows a working surface of MSUs on top of a base, where inter MSU space is considerable.
Figure 15:
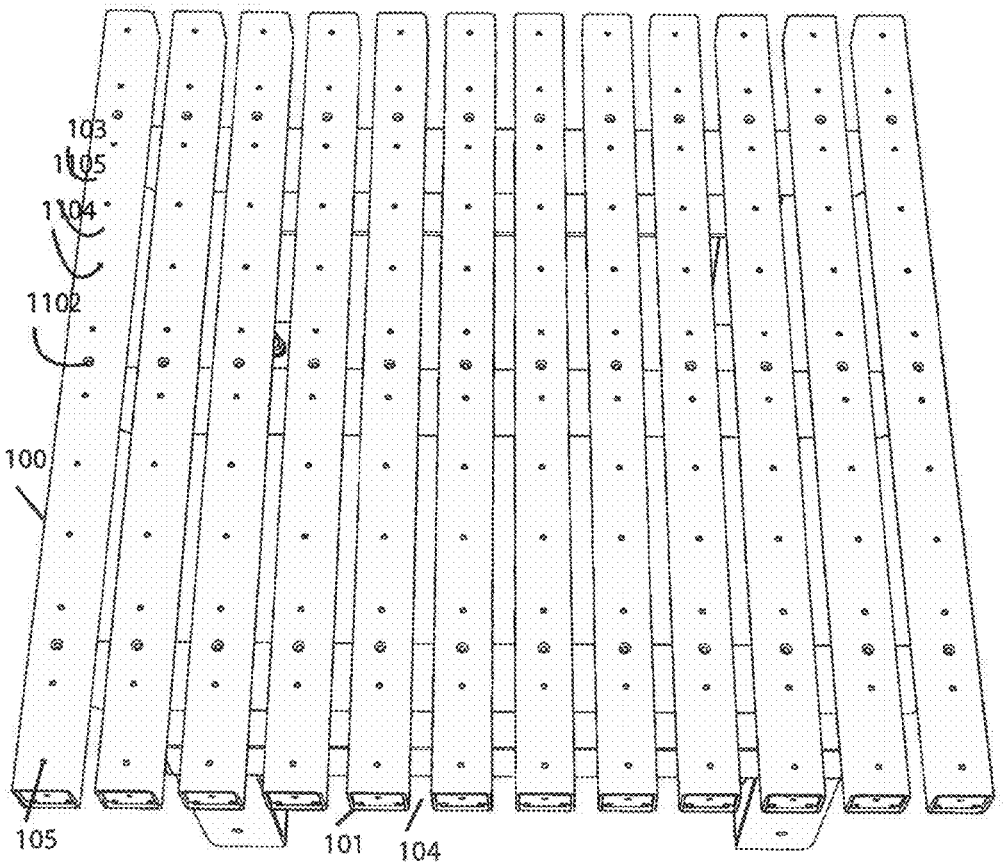
FIG. 15 is a top perspective view which shows a working surface of MSUs on top of a base.
Figure 16:
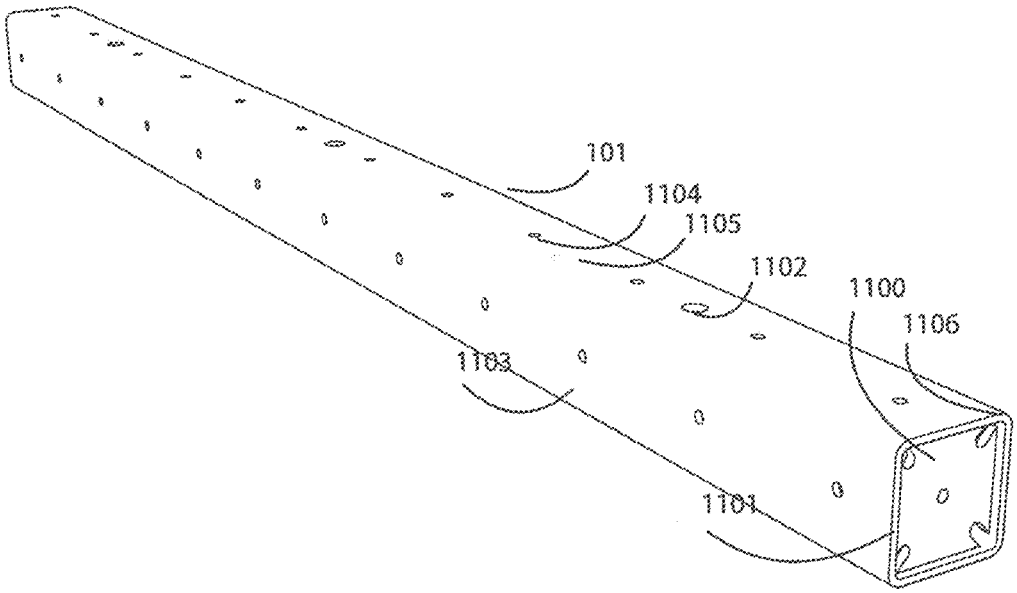
FIG. 16 is a side perspective view which shows an MSU.

Referring now to FIGS. 9 and 10, which shows an MFU. In some embodiments, MFU monitoring holes 900 has a preferred diameter of 0.375 inches but in other embodiments, may range from a minimum of 0.125 inches to a maximum diameter of 1 inches. In general, the preferred diameter value can be calculated by that that is the same as the wall thickness of the MFU. In general, the maximum diameter value can be calculated by that that prevents interface with the structural components. MFU monitoring holes 900 has many purposes which are as follows: First, the purpose of MFU monitoring holes 900 is to allow drainage. Next, it serves to clean out materials that have fallen through. Lastly, MFU monitoring holes 900 serves to run wires through for peripherals or other purposes.

In some embodiments, it is thought that if MFU monitoring holes 900 is absent then one may have MFU 112 that is still functional. In some embodiments, MFU center fixturing hole 901 has a preferred diameter of 0.375 inches but in other embodiments, may range from a minimum of 0.125 inches to a maximum diameter of 1 inches. In general, the preferred value can be calculated by that that is the same as the wall thickness of the MFU. In general, the maximum thickness value can be calculated that that prevents interference with the structural components. MSU attachment aperture 902 allows the MFU to attach to one more MSU 101.

Referring now to FIGS. 11, 12, 13, 14, 15 and 16, which shows a working surface of MSUs on top of a base. MSU end cap 1100 functions to both 1) support the tube during stress and to 2) allow attachment for fixtures. MSU end cap 1100 is mainly thought to be composed of steel, however other embodiments may be composed of any of the following: stainless steel, aluminum, plastic, polymers, rubber polymers, composites with different coatings, or any suitable metal. In some embodiments, MSU end cap 1100 has a preferred thickness of 3/16 inches but in other embodiments, may range from a minimum of 1/8 inches to a maximum thickness of 1 inches. In general, the preferred value can be calculated by having the same as the wall thickness of the MSU.

MSU end cap 1100 functions to both 1) support the tube during stress and to 2) allow attachment for fixtures. In some embodiments, it is thought that if MSU end cap 1100 is absent then there may be no end cap, though it may be less adaptable and less resistant to stress. MSU end cap 1100 preferably comprises a MSU monitoring hole, MSU center fixturing hole 1700, and finally end cap inset distance 1701. MSU end cap 1100 has an alternative embodiment herein termed the 'removable end cap' embodiment. The 'removable end cap' embodiment comprises an embodiment where there the end cap can be removed in order to have access to the interior aperture.

MSU end angle 1101 is preferably positioned perpendicular to MSU top surface 103, perpendicular to MSU side surface 1103, and perpendicular to MSU bottom surface 1800. One goal of MSU end angle 1101 is to establish a perpendicular plane for one or more peripheral or MSU 101 to be attached. In a preferred embodiment, MSU end angle 1101 has a preferred angle of 90 degrees but in other embodiments, the angle may vary.

Fixturing aperture 1104 (as in FIG. 11) comprises an aperture through one or more sides of MSU 101 that when combined with one or more other fixturing aperture 1104 makes a fixture aperture grid 105 for combining one or more MSU 101 and potentially one or more fixturing peripheral 2700. One goal of fixturing aperture 1104 is to allow one or more AM or fixturing peripheral 2700 to be attached to MSU 101. In some embodiments, it is thought that if fixturing aperture 1104 is absent then there are no apertures and the table can be used without peripherals that attach through one or more fixturing aperture 1104.

Recessed anchoring aperture 1102 (as in FIG. 11) comprises a mechanism for threading an AM through MSU top surface 103 to the bottom surface in order to maintain a flat work surface 100. One goal of recessed anchoring aperture 1102 is to allow threading of an AM in order to attach one or more MSU or MFU to one another. Fixturing aperture distance 1105 (as in FIG. 11) comprises the distance between two adjacent fixturing aperture 1104 on the same surface of MSU 101.

In some embodiments, fixturing aperture distance 1105 has a preferred length of 5 inches but in other embodiments, may range from a minimum of 0.5 inches to a maximum length of 24 inches. In general, the preferred length value can be calculated by the size of fixture aperture grid 105 that one wants to create. MSU side surface 1103 (as in FIG. 11) comprises the perpindicular surface to MSU top surface 103 adjoined by corner radial curve 1106. Corner radial curve 1106 (as in FIG. 11) comprises the smoothed edge between adjacent surface of MSU 101. Corner radial curve 1106 functions to both 1) allow one to slide in peripherals more easily and to 2) allows one to carry the MSU more easily. In some embodiments, it is thought that if corner radial curve 1106 is absent then the corners may be at 90 degrees.

Figure 17:
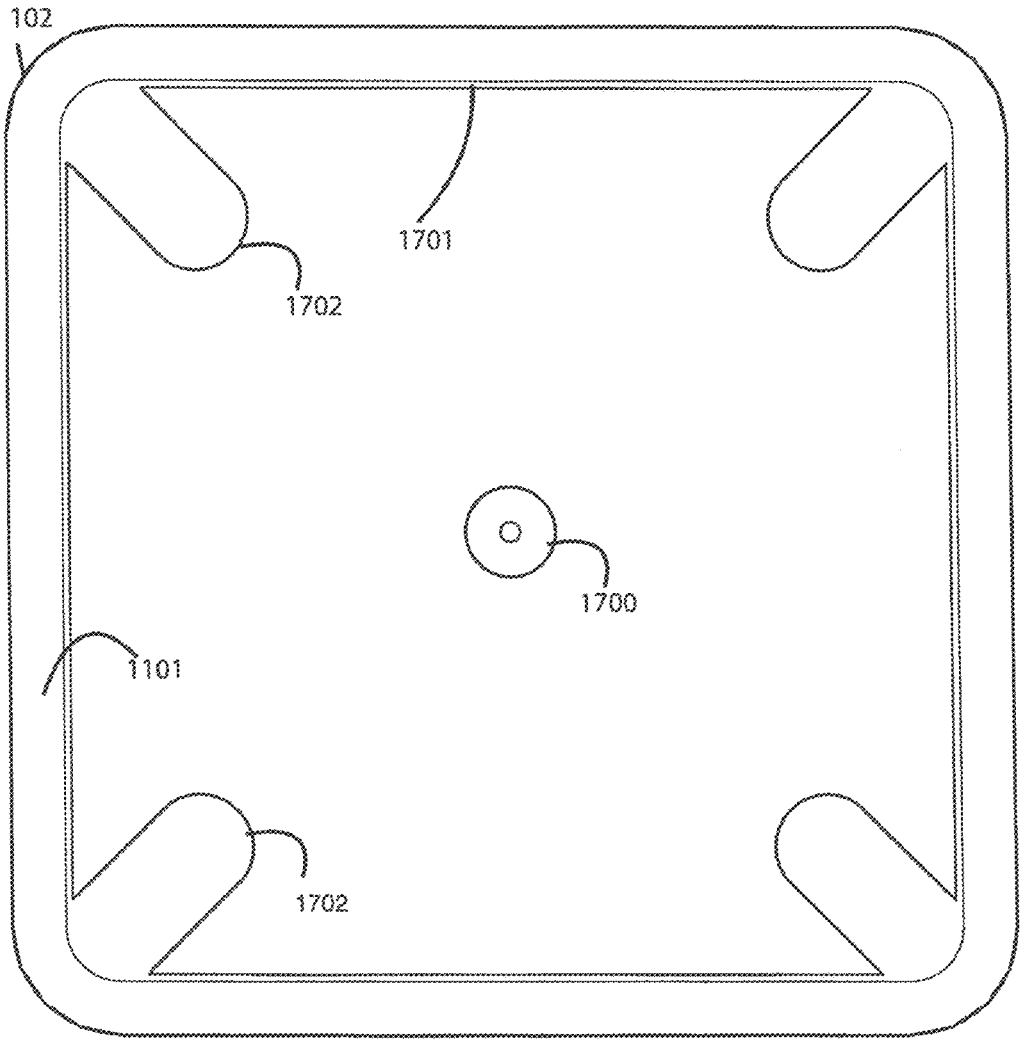
FIG. 17 is a end facing perspective view which shows an MSU end.

Referring now to FIG. 17, which shows an MSU end. The MSU monitoring hole 1702 has many purposes which are as follows: First, the purpose of the MSU monitoring hole 1702 is to allow drainage. Next, it serves to clean out materials that have fallen through. Lastly, the MSU monitoring hole 1702 serves to run wires through for peripherals or other purposes. In some embodiments, it is thought that if the MSU monitoring hole 1702 is absent then then one may have an MSU that is still functional. In a preferred embodiment, MSU monitoring hole 1702 has a preferred diameter of 0.5 inches but in other embodiments, the diameter may have a maximum value of 1 inches. In general, the preferred diameter value can be calculated by the same value as the wall thickness of the MSU. In general, the maximum diameter value can be calculated by the diameter value that does not to interfere with the structural components.

The MSU center fixturing hole 1700 allows attachment to other MSU 101 and/or peripherals. In a preferred embodiment, MSU center fixturing hole 1700 has a preferred diameter of 0.5 inches but in other embodiments, the diameter may have a maximum value of 1 inches. In general, the preferred diameter value can be calculated by the same value as the wall thickness of the MSU. In general, the maximum diameter value can be calculated by the diameter value that does not to interfere with the structural components. One goal of end cap inset distance 1701 is to allow one to leave hardware attached to the end cap and not have it interact with a user. In some embodiments, it is thought that if end cap inset distance 1701 is absent then there may be no inset distance. End cap inset distance 1701 has a preferred depth of 5/16 inches but in other embodiments, the diameter may have a maximum value of 3 inches.

Figure 18:
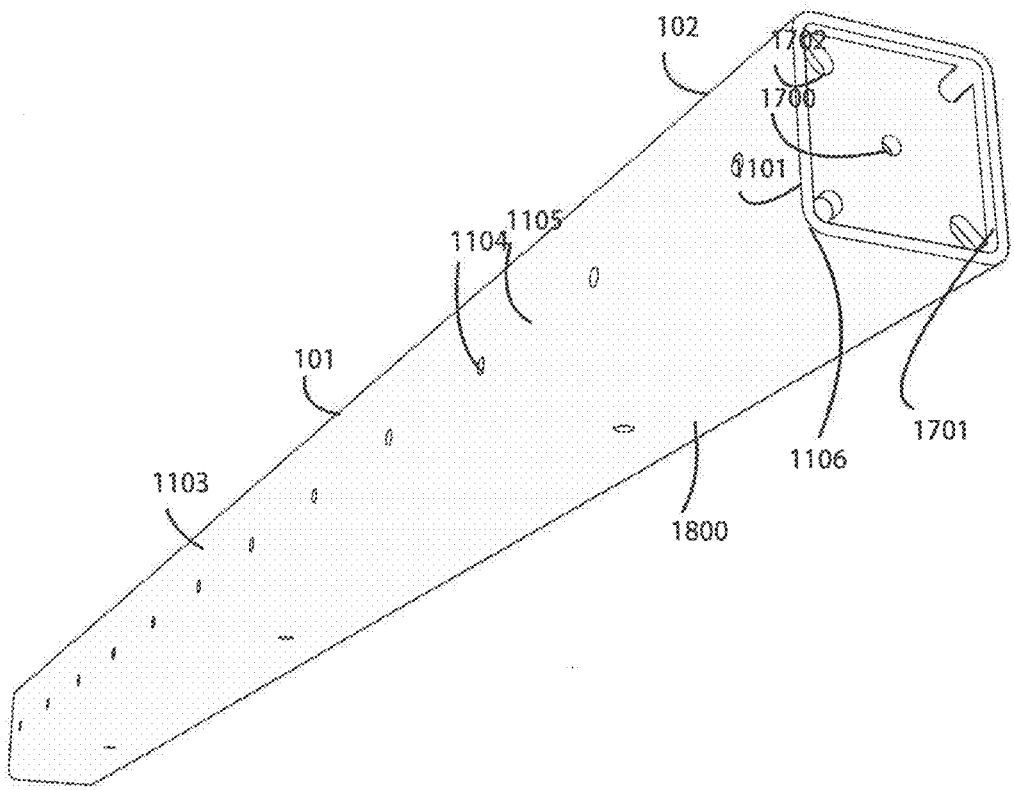
FIG. 18 is a bottom perspective view which shows an MSU.
Figure 19:
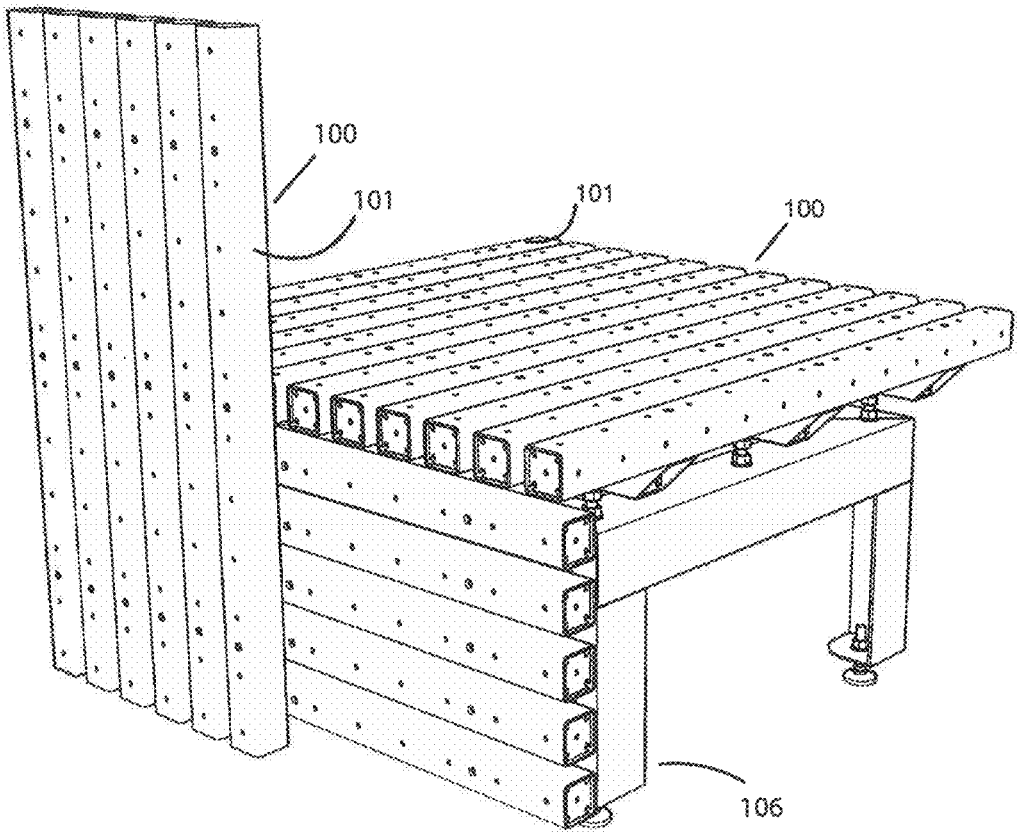
FIG. 19 is a perspective view which shows multiple vertical and horizontal work surfaces.
Figure 20:
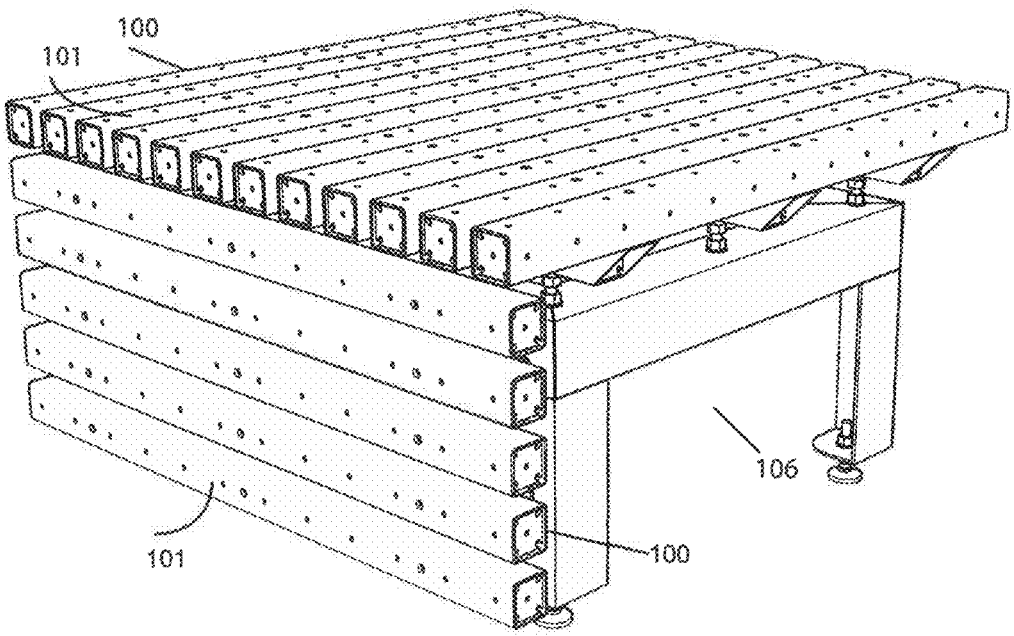
FIG. 20 is a perspective view which shows a work surface attached vertical below the plane of the horizontal work surface.
Figure 21:
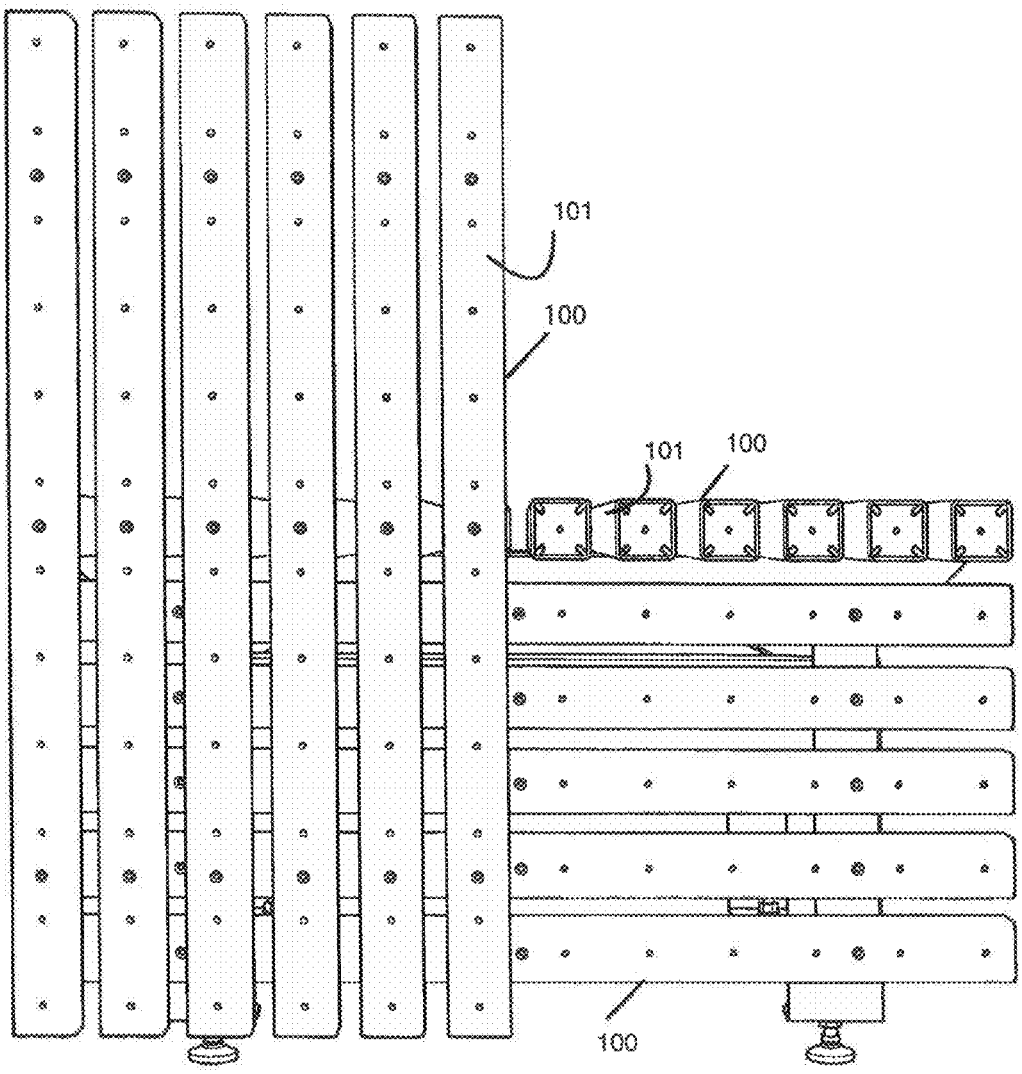
FIG. 21 is a end facing perspective view which shows multiple vertical and horizontal work surfaces.
Figure 22:
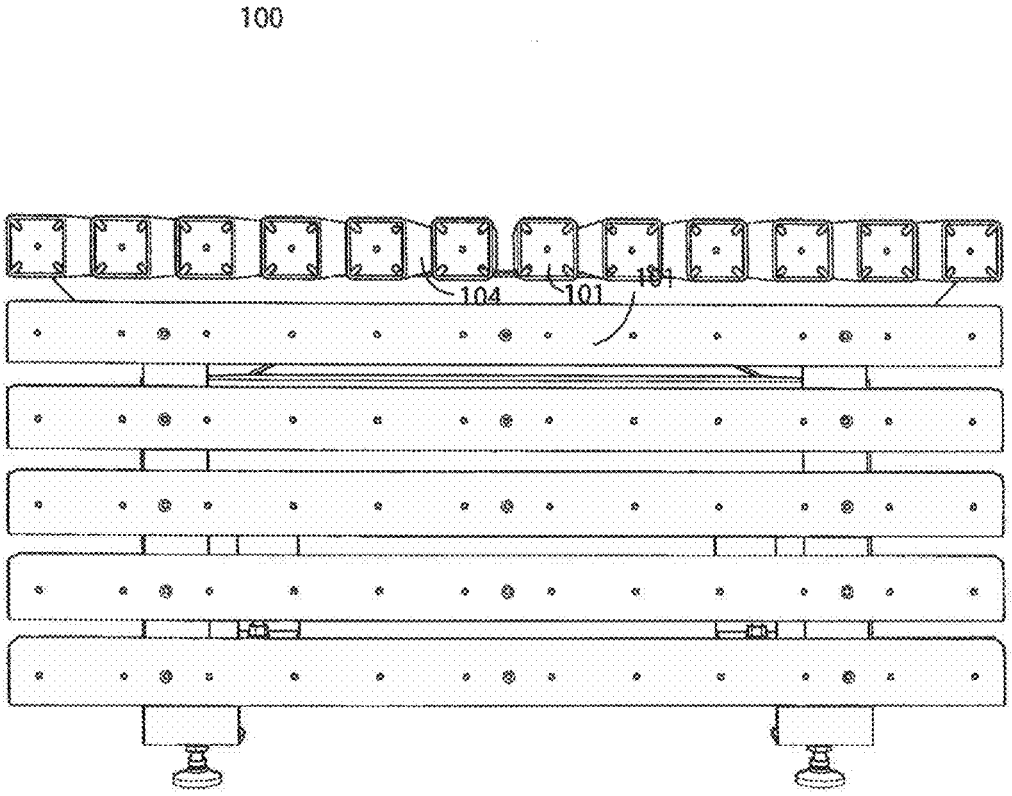
FIG. 22 is a side perspective view which shows multiple vertical and horizontal work surfaces.
Figure 23:
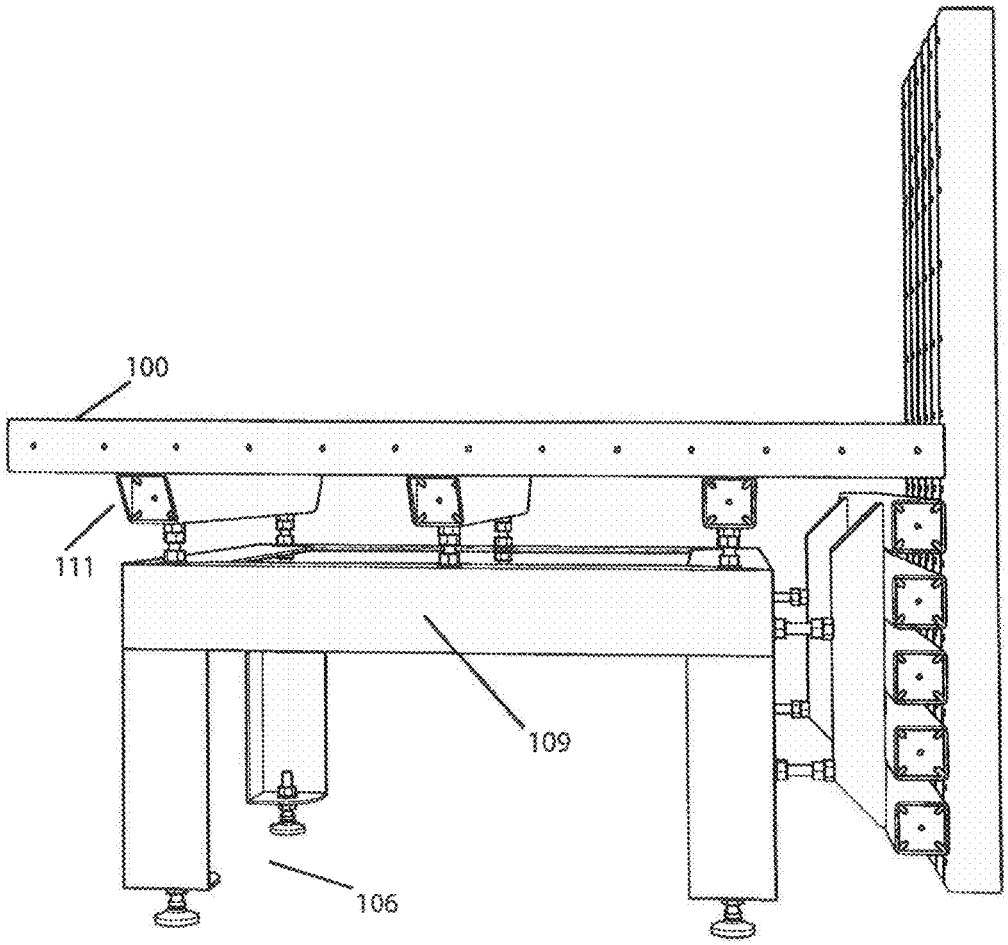
FIG. 23 is a top perspective view which shows multiple integrated horizontal work surfaces with multiple bases.
Figure 24:
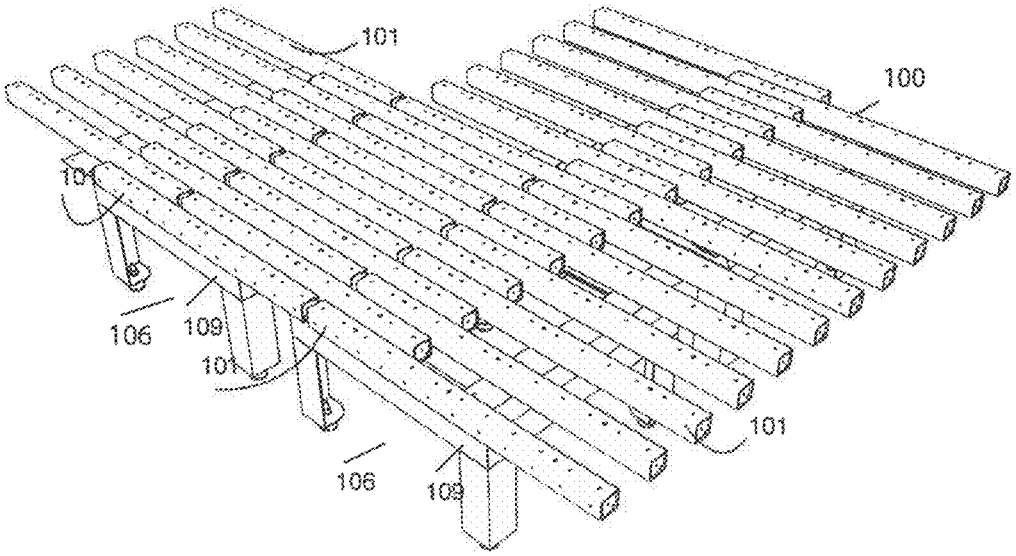
FIG. 24 is a top perspective view which shows multiple integrated horizontal work surfaces with multiple bases.
Figure 25:
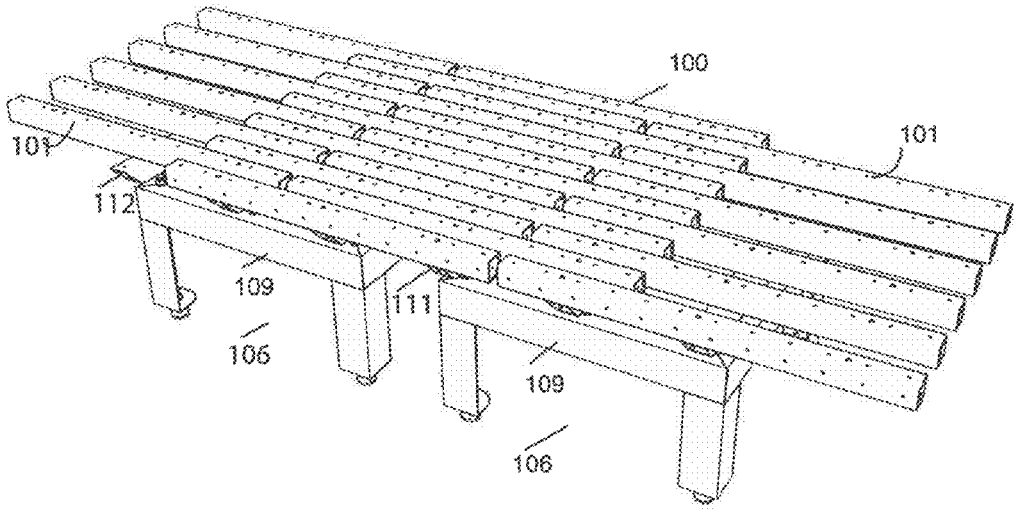
FIG. 25 is a top perspective view which shows multiple integrated horizontal work surfaces with multiple bases.
Figure 26:
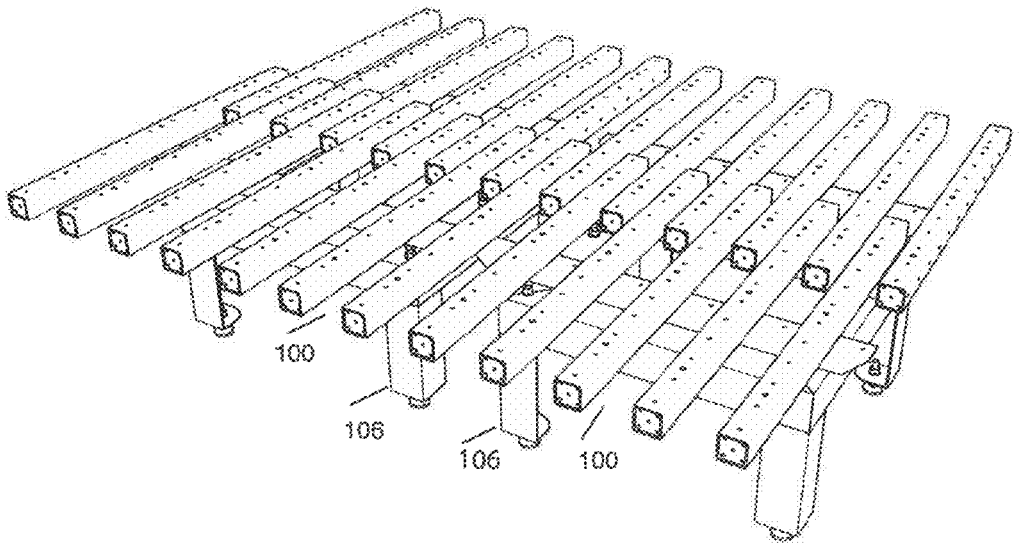
FIG. 26 is a side perspective view which shows a horizontal work surfaces and fence peripheral.

Referring now to FIG. 18, 19, 20, 21, 22, 23, 24, 25, 26 which shows an MSUs and works surfaces in various configurations. MSU bottom surface 1800 (as in FIG. 18) comprises the surface that faces towards anchoring surface 111 which contains the hole through which one or more AM is used to attach MSU 101 via recessed anchoring aperture 1102 from the top surface.

Figure 27:
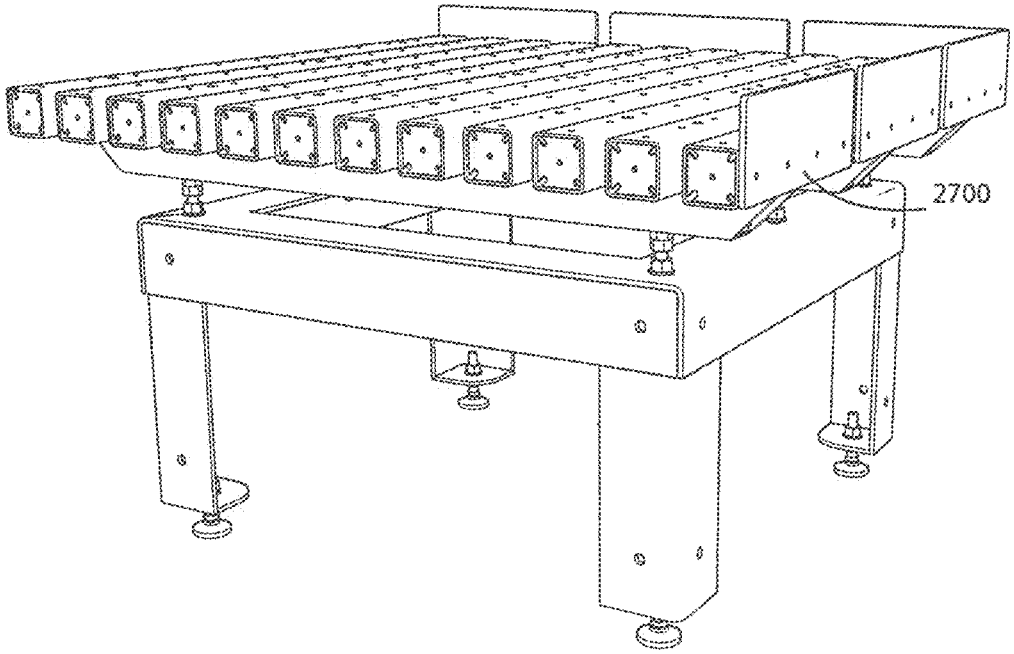
FIG. 27 is a perspective view which shows an embodiment where a peripheral is attached to the work surface.
Figure 28:
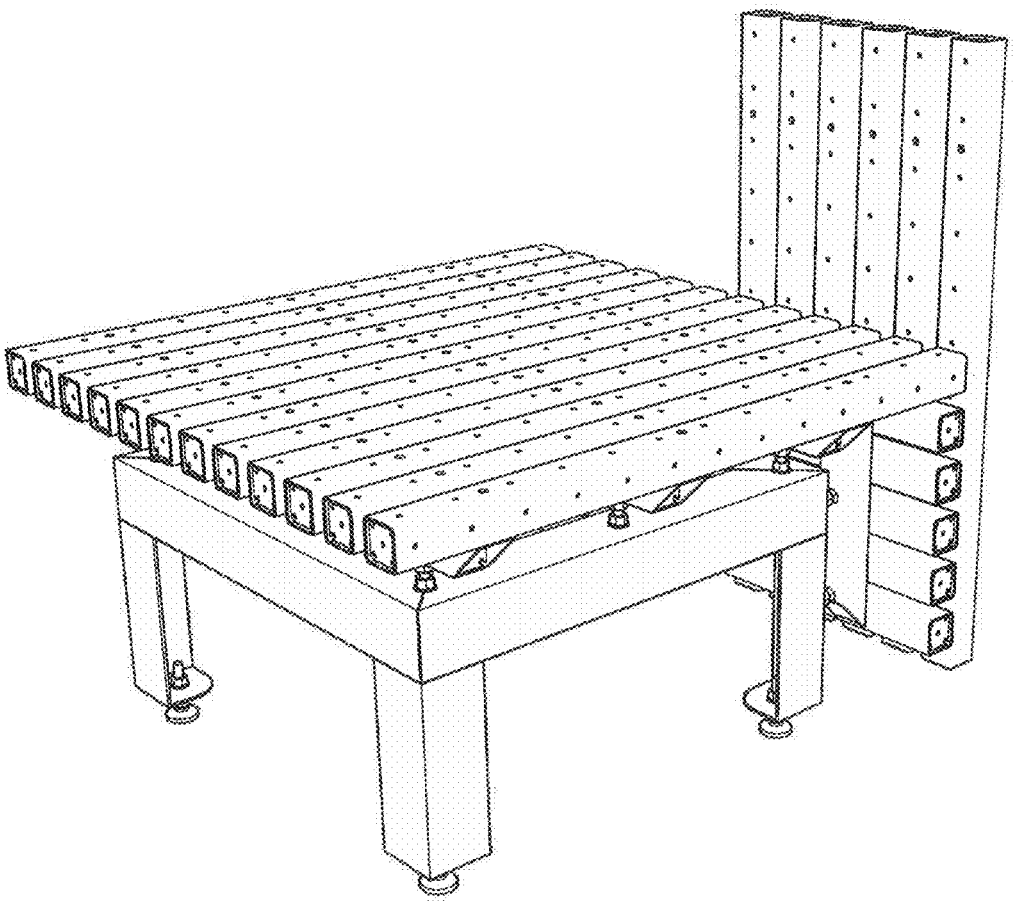
FIG. 28 is a perspective view which shows an embodiment where there are horizontal and vertical work surfaces.
Figure 29:
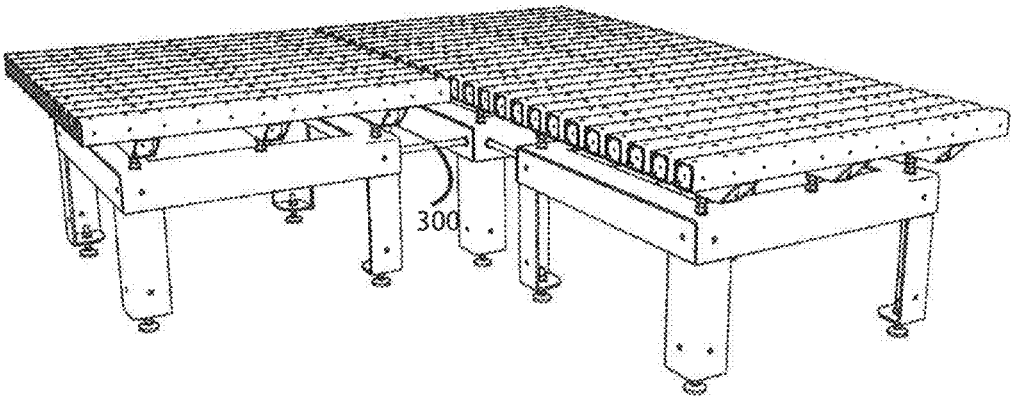
FIG. 29 is a top perspective view which shows multiple integrated horizontal work surfaces with multiple bases attached with components between bases.
Figure 30:
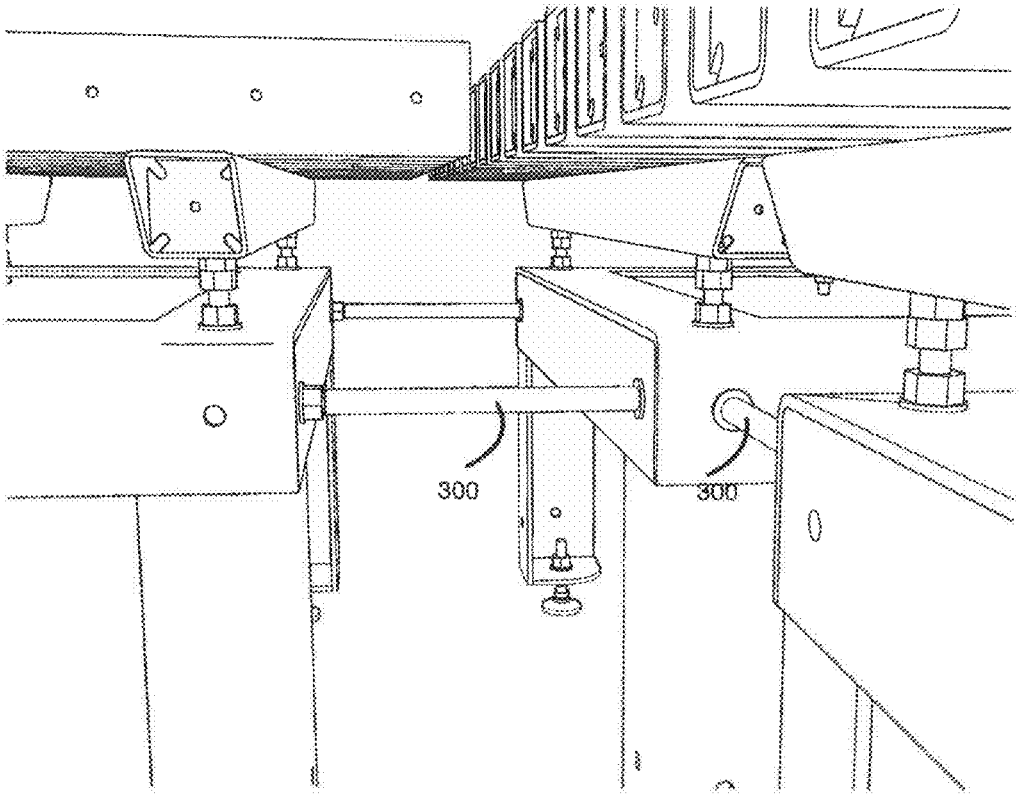
FIG. 30 is a side perspective view which shows multiple integrated horizontal work surfaces with multiple bases attached with components between bases.

Referring now to FIG. 27, 28, 29 30 which shows a peripheral attached to a work surface and various work surface configurations. Fixturing peripheral 2700 (as in FIG. 27) comprises a component that is used for fixturing that operably attaches to MSU 101, or in some embodiments additionally one or more MFU 112. In some embodiments, it is thought that examples of fixturing peripheral 2700 may include: clamps, ratchet straps, threaded hardware, or set up kits. Fixturing peripheral 2700 has multiple alternative embodiments herein termed the 'diagonal accommodating' embodiment, the 'fence' peripheral embodiment, the 'plate' peripheral embodiment, and the 'clamp' peripheral embodiment.

The 'diagonal accommodating' embodiment comprises an embodiment that accommodates the diagonal threaded distance which may be specific to peripherals added to the table. The 'fence' peripheral embodiment comprises a peripheral that creates a fence like structure surrounding the work surface 100. the 'plate' peripheral embodiment comprises a peripheral that lays a plate down over some portion of the work surface 100. and the 'clamp' peripheral embodiment comprises a peripheral that clamps to one or more portions of the work surface 100.

Figure 31:
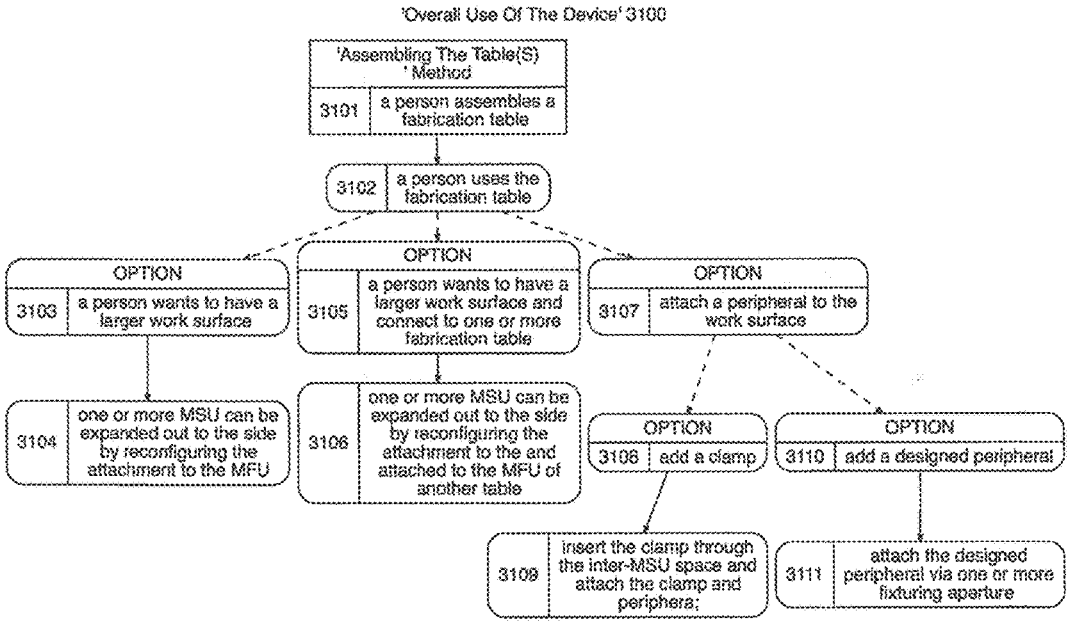
FIG. 31 is a diagram view which shows overall use of the device.
Figure 32:
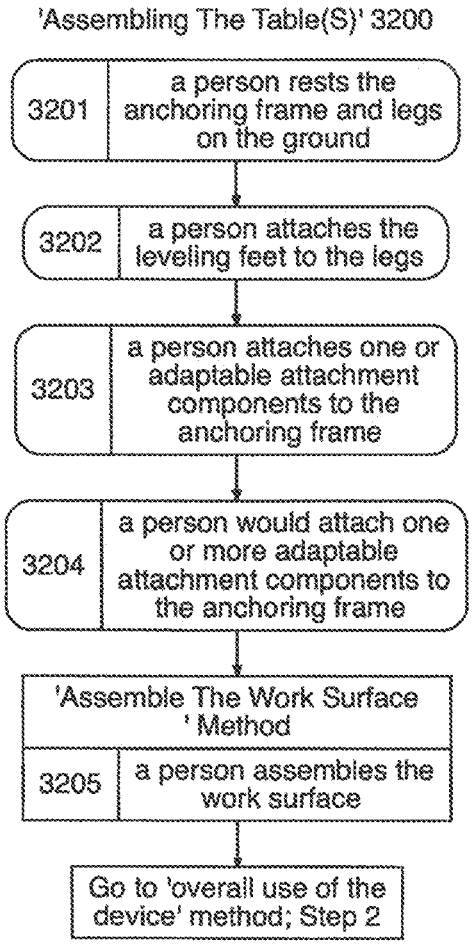
FIG. 32 is a diagram view which shows an embodiment of a method to assemble the table.

Referring now to FIG. 31, overall, a preferred embodiment of the invention is used as follows: First, a person assembles a fabrication table (Step 3101). This is further detailed below in (Step 3201-Step 3205). Now referring to FIG. 32, first, a person lays an anchoring frame 109 and legs on the ground (Step 3201). Next, a person attaches the leveling feet to legs 107 (Step 3202). Next, a person attaches one or adaptable attachment components 300 to anchoring frame 109 (Step 3203). Next, a person would attach one or more adaptable attachment components 300 to anchoring frame 109 (Step 3204). Next, a person assembles the work surface (Step 3205). This is further detailed below in (Step 3301-Step 3303).

Figure 33:
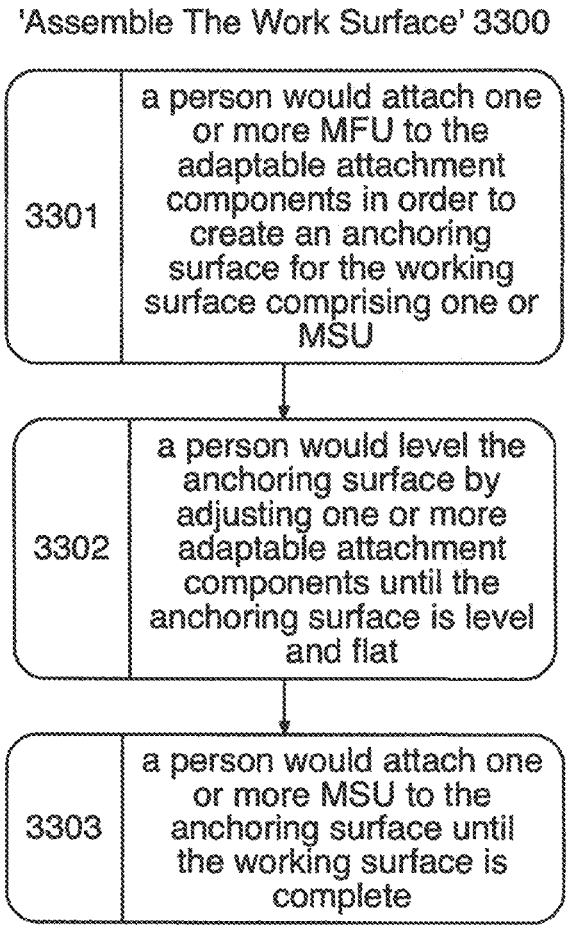
FIG. 33 is a diagram view which shows an embodiment of a method to assemble the work surface.

Now referring to FIG. 33, in order to assemble the work surface, a person would attach one or more MFU 112 to adaptable attachment components 300 in order to create anchoring surface 111 for working surface 100 comprising one or MSU 101 (Step 3301). Next, a person would level the anchoring surface 111 by adjusting one or more adaptable attachment components 300 until anchoring surface 111 is level and flat (Step 3302). Next, a person would attach one or more MSU 101 to anchoring surface 111 until the working surface is complete (Step 3303).

Referring back to FIG. 31, after assembly, a person uses the fabrication table (Step 3102). If a person wants to have a larger work surface 100 (Step 3103), then, one or more MSU 101 can be expanded out to the side by reconfiguring the attachment to the MFU (Step 3104). If a person wants to have a larger work surface 100 and connect to one or more fabrication table (Step 3105), then, one or more MSU 101 can be expanded out to the side by reconfiguring the attachment to the and attached to MFU 112 of another table (Step 3106). If one attaches a peripheral to the work surface 100 (Step 3107) and if they add a clamp (Step 3108), then, one may insert the clamp through inter-MSU space 104 and attach the clamp and peripheral (Step 3109). If one attaches a peripheral to the work surface 100 (Step 3107) and then adds a designed peripheral (Step 3110) then one may attach the designed peripheral via one or more fixturing aperture 1104 (Step 3111).

The invention has some elements that are commonly known and other terms defined as specific to this specification. These include: fabricator, AM, work piece, and finally apron. However their use and relationships to the novel components and steps of the invention render them applicable herein. In order to preface the roles they play in the specification, they are subsequently explained here.

A fabricator comprises a user of a modular fabrication table that requires one or more configurable adaptations during the course of fabrication for one or more work piece. In some embodiments, examples of a fabricator may include: welders, engineers, inventors, hobbyists, or machine shop patrons. AM (anchoring mechanism) comprises a user of a the modular fabrication table that requires one or more configurable adaptations during the course of fabrication for one or more pieces. In some embodiments, an example of AM could be clamps, screws or bolts and the like. A work piece comprises one or more physical components that is configured to be positioned relative to the fabrication table and to have work being done on it.

What is claimed is:

1. An apparatus for a modular fabrication table comprising:

a. A working surface wherein the working surface comprises:
   i. A plurality of modular surface units (MSUs); wherein each of said MSUs comprises
      an MSU end comprising an MSU monitoring hole, an MSU center fixturing hole and an end cap inset distance, and an MSU end angle,
      an MSU top surface,
      an MSU side surface,
      an MSU bottom surface,
      an MSU interior aperture,
      a plurality of fixturing apertures,
      one or more fixturing aperture distances, and
      one or more corner radial curves: and
   ii. A plurality of inter-MSU spaces between said plurality of MSUs; and
   iii. At least one fixture aperture grid on each of said plurality of MSUs;
b. A base attachable to said plurality of MSU, wherein the base comprises:
   i. One or more legs wherein said one or more legs further comprise a leveling mechanism;
   ii. An anchoring frame attachable to said one or more legs such that said anchoring frame is supported by said one or more legs;
   iii. One or more adaptable attachment components attachable to said anchoring frame; and
   iv. An anchoring surface comprised of one or more modular foundation attachable to said one or more adaptable attachment components;
c. A fixturing peripheral attachable to at least one of said MSU ends.

2. The apparatus of claim 1 wherein said plurality of adaptable attachment components comprises:

a. a separator rod: and
b. a micro adjustment leveling mechanism.

3. The apparatus of claim 1 wherein the anchoring surface further comprises:

a. A modular framing unit (MFU), wherein the MFU comprises:
   i. an MFU end;
   ii. an MFU top surface;
   III. an MFU side surface;
   iv. an MFU bottom surface;

v. One or more MFU attachment apertures; and vi. One or more MFU interior apertures;

b. An inter-MFU space between said plurality of MFUs.

4. The apparatus of claim 3 wherein the MFU end comprises:

a. one or more MFU angled edges; and b. one or more MFU end caps.

5. The apparatus of claim 4 wherein the MFU end caps comprise:

i. one or more MFU monitoring holes and;

ii. one or more MFU center fixturing holes.

* * * * *